US012097446B2

(12) United States Patent
Atwood

(10) Patent No.: US 12,097,446 B2
(45) Date of Patent: Sep. 24, 2024

(54) BUILDING TOY

(71) Applicant: ATWOOD ROPE MFG, Millersport, OH (US)

(72) Inventor: Curtis Dale Atwood, Millersport, OH (US)

(73) Assignee: ATWOOD ROPE MFG, Millersport, OH (US)

( * ) Notice: Subject to any disclaimer, the term of this patent is extended or adjusted under 35 U.S.C. 154(b) by 199 days.

(21) Appl. No.: 17/608,628

(22) PCT Filed: May 6, 2020

(86) PCT No.: PCT/US2020/031618
§ 371 (c)(1),
(2) Date: Nov. 3, 2021

(87) PCT Pub. No.: WO2020/227370
PCT Pub. Date: Nov. 12, 2020

(65) Prior Publication Data

US 2022/0212117 A1 Jul. 7, 2022

Related U.S. Application Data

(60) Provisional application No. 62/843,655, filed on May 6, 2019.

(51) Int. Cl.
*A63H 33/04* (2006.01)
*A63H 33/10* (2006.01)

(52) U.S. Cl.
CPC ..... *A63H 33/10* (2013.01)

(58) Field of Classification Search
CPC ..... A63H 33/04; A63H 33/062; A63H 33/10; A63H 33/101; A63H 33/102; A63H 33/108
(Continued)

(56) References Cited

U.S. PATENT DOCUMENTS 2,609,638 A * 9/1952 Lindenmeyer ..... G09B 25/02 446/124
3,458,949 A * 8/1969 Young ..... A63H 33/108 446/124
(Continued)

OTHER PUBLICATIONS

Patent Cooperation Treaty (PCT), International Search Report and Written Opinion for Application PCT/US2020/031618 filed May 6, 2020, mailed Jul. 31, 2020, International Searching Authority, US.

*Primary Examiner* — Alexander R Niconovich
(74) *Attorney, Agent, or Firm* — McDonald Hopkins LLC

(57) ABSTRACT

A toy, game, and/or puzzle building system may comprise variously shaped connectors that are operatively attachable to other connectors or rods. The connectors may include a receiving portion adapted to receive a rod and may connect two, three, four, five, etc. rods in various angles and orientations. The connectors may include a receiving portion adapted to receive another connector. Multiple rods may be connected in 2-D and 3-D configurations and orientations. Both the rods and connectors may be provided in a variety of lengths, shapes, colors, and sizes. Additionally, the connectors may be used with any existing items, such as a plastic or wooden toothpick, straw, stirrer, and the like, that may fit within the receiving portions of the connectors. The toy picks building system may be built into a particular shape, item, vehicle, animal, person, building, scene, or landscape.

19 Claims, 18 Drawing Sheets

(58) Field of Classification Search
USPC ..... 446/85, 120, 122, 124, 126
See application file for complete search history.

(56) References Cited

U.S. PATENT DOCUMENTS

| | | | | | |
|---|---|---|---|---|---|
| 3,648,404 | A * | 3/1972 | Ogsbury | A63H 33/102 | 403/176 |
| 3,747,261 | A * | 7/1973 | Salem | B23Q 1/545 | 446/124 |
| 3,822,499 | A * | 7/1974 | De Vos | A63H 33/108 | D25/13 |
| 4,471,595 | A * | 9/1984 | Lanzafame | A63H 33/105 | 403/56 |
| 4,637,805 | A * | 1/1987 | Sweetin | A63H 33/108 | 403/172 |
| 4,787,191 | A * | 11/1988 | Shima | A63H 33/088 | 403/171 |
| 5,049,105 | A * | 9/1991 | Glickman | A63H 33/10 | 446/107 |
| 5,137,486 | A * | 8/1992 | Glickman | A63H 33/101 | 446/124 |
| 5,238,438 | A * | 8/1993 | Glickman | A63H 33/062 | 446/124 |
| 5,421,666 | A * | 6/1995 | Spears | F16B 7/0446 | 52/81.3 |
| 5,704,186 | A * | 1/1998 | Alcalay | A63H 33/062 | 446/124 |
| 5,769,681 | A * | 6/1998 | Greenwood, Sr. | A63H 33/101 | 446/120 |
| 5,897,417 | A * | 4/1999 | Grey | F16M 11/14 | 403/90 |
| 6,059,631 | A * | 5/2000 | Maddock | A63H 33/12 | 446/127 |
| 6,491,563 | B1 * | 12/2002 | Bailey | A63H 33/062 | 446/120 |
| 6,537,130 | B1 * | 3/2003 | Lee | A63H 3/04 | 446/485 |
| 6,641,453 | B1 * | 11/2003 | Morales | A63H 33/04 | 446/124 |
| 6,676,474 | B2 * | 1/2004 | Glickman | A63H 33/062 | 446/124 |
| 6,948,998 | B2 * | 9/2005 | Bagley | A63H 33/062 | 446/124 |
| 8,651,914 | B2 * | 2/2014 | Sisamos | A63H 33/101 | 446/85 |
| 8,968,046 | B2 * | 3/2015 | Cochella | A63H 33/062 | 446/111 |
| 9,399,177 | B2 * | 7/2016 | Cochella | A63H 33/101 | |
| 9,649,573 | B2 * | 5/2017 | Phamdo | A63H 33/102 | |
| 10,159,905 | B2 * | 12/2018 | Bagley | A63H 33/088 | |
| 10,398,999 | B2 * | 9/2019 | Cochella | A63H 33/046 | |
| 10,493,371 | B2 * | 12/2019 | Cochella | A63H 33/101 | |
| 10,518,193 | B2 * | 12/2019 | You | A63H 33/107 | |
| 2002/0090880 | A1 * | 7/2002 | Lee | A63H 3/04 | 446/85 |
| 2004/0154256 | A1 * | 8/2004 | Kim | E04B 2/08 | 52/592.6 |
| 2007/0281578 | A1 * | 12/2007 | Sambenedetto | A63H 33/04 | 446/102 |
| 2013/0095722 | A1 * | 4/2013 | Cochella | A63H 33/046 | 446/85 |
| 2014/0045403 | A1 * | 2/2014 | Murphy | A63H 33/08 | 446/124 |

* cited by examiner

BUILDING TOY

CROSS-REFERENCE TO RELATED APPLICATIONS

This application is a 35 U.S.C. 371 national stage filing of PCT Application No. PCT/US2020/031618 filed on May 6, 2020, which claims the priority to U.S. Provisional Patent App. No. 62/843,655 filed on May 6, 2019 and entitled "Toy Picks," which is incorporated herein by reference in their entireties.

FIELD OF THE INVENTION

The present disclosure relates generally to toy, game, and/or puzzle building pieces and, more particularly, to variously-shaped connectors and/or rods that are adaptable to connect in a multitude of configurations and angles.

SUMMARY

The following presents a summary of this disclosure to provide a basic understanding of some aspects. This summary is not intended to identify key or critical elements or define any limitations of embodiments or claims. Furthermore, this summary may provide a simplified overview of some aspects that may be described in greater detail in other portions of this disclosure.

Disclosed is a toy, game, and/or puzzle building system. The toy picks building system may comprise variously shaped connectors that are operatively attachable to other connectors or to rods. The connectors may include a receiving portion adapted to receive a rod and may connect two, three, four, five, etc. rods in various angles and orientations. For instance, two rods may be connected in a straight line, at a right angle, at an obtuse angle, at an acute angle, etc. The connectors may include a receiving portion adapted to receive another connector. Multiple rods may be connected in 2-D and 3-D configurations and orientations, for example, two rods at a right angle encompassing the x and y directions or three rods at right angles encompassing the x, y, and z directions. Both the rods and connectors may be provided in a variety of lengths, shapes, colors, and sizes. Additionally, the connectors may be used with any existing items, such as a plastic or wooden toothpick, straw, stirrer, and the like, that may fit within the receiving portions of the connectors. The toy picks building system may be built into a particular shape, item, vehicle, animal, person, building, scene, landscape or the like. The toy picks building system may also allow for freehand building. The various components and versatility between components allow for the creation of limitless configurations, shapes, and images.

Disclosed is a toy building system. The toy building system may comprise a connector. The connector may comprise at least one arm and the at least one arm may comprises a first end, a second end, a body, and an elongated channel. The elongated channel may extend from at least one of the first or second end and through a length, or portion thereof, of the body. The elongated channel may serve as a first mating portion. The elongated channel may be configured to operatively receive a first mating piece.

The toy building system may comprise a rod. The rod may include a first end, a second end, and a body. The at least the first end or the second end may be an elongated end. The elongated end may form the first mating piece.

In an embodiment, the first mating piece may be an end of a toothpick.

In an embodiment, the connector may include two arms and wherein the two arms may be positioned linearly at a 180° angle. In an embodiment, the connector may include two arms and wherein the two arms may be positioned at a 90° angle. In an embodiment, the connector may include two arms and wherein the two arms may be positioned at an obtuse angle. In an embodiment, the connector may include two arms and wherein the two arms may be positioned at an acute angle. In an embodiment, the connector may include three arms and wherein the three arms may be positioned in a planar T-shape. In an embodiment, the connector may include three or more arms and wherein the three or more arms may be positioned in the same plane. In an embodiment, the three or more arms may be positioned around a center point. In an embodiment, 7 arms may be positioned around a center point to form 7 spaces between adjacent arms and wherein 6 of the spaces may be equal angles. The $7^{th}$ space may include a second mating portion. In an embodiment, the connector may include three or more arms, wherein at least one arm may be positioned in a different plane.

In any of the described embodiments herein, the arms may connect at a juncture. The juncture may further comprise a second mating portion. The second mating portion may be configured to receive a second mating piece. In an embodiment, a body of a rod or a juncture of a second connector may form the second mating piece.

In an embodiment, the toy building system may further comprise a wheel. The wheel may include a central hub. The central hub may include an aperture, a plurality of arms positioned planarly around the central hub, and an outer rim. Each of the plurality of arms may include a first end, a second end, a body, and an elongated channel. The elongated channel may extend from the first end and through a length, or portion thereof, of the body. The elongated channel may serve as a first mating portion. The elongated channel may be configured to operatively receive the first mating piece.

In an embodiment, the toy building system may further comprise an axle. The axle may be operatively engageable with the central hub of the wheel. The axle may include a channel configured to operatively receive the first mating piece.

Disclosed is a toy building system. The toy building system may comprise at least one connector and at least one rod. The connector may comprise at least two arms each having a first end, a second end, and a body. Each arm may include a first receiving cavity at the first end and through a length, or portion thereof, of the body. The second ends of each arm may connect at a juncture. The connector may include a second receiving cavity at the juncture. The rod may comprise a first end, a second end, and a body. The first end of the rod may comprise a first corresponding mating portion that may be configured to operatively engage the first receiving cavity of the connector. The body of the rod may comprise a second mating portion that may be configured to operatively engage the second receiving cavity of the connector.

In an embodiment, a second receiving cavity of a second connector may be configured to operatively engage a second receiving cavity of a first connector.

In any of the described embodiments herein, the toy building system, and any components thereof, may be formed from one or more of plastics, acrylics, polymers, or silicones. In any of the described embodiments herein, the toy building system, and any components thereof, may be 3-D printed, molded, stamped, or extruded.

The following description and the drawings disclose various illustrative aspects. Some improvements and novel aspects may be expressly identified, while others may be apparent from the description and drawings.

BRIEF DESCRIPTION OF THE DRAWINGS

The present teachings may be better understood by reference to the following detailed description taken in connection with the following illustrations, wherein.

DETAILED DESCRIPTION

Figure 1A:
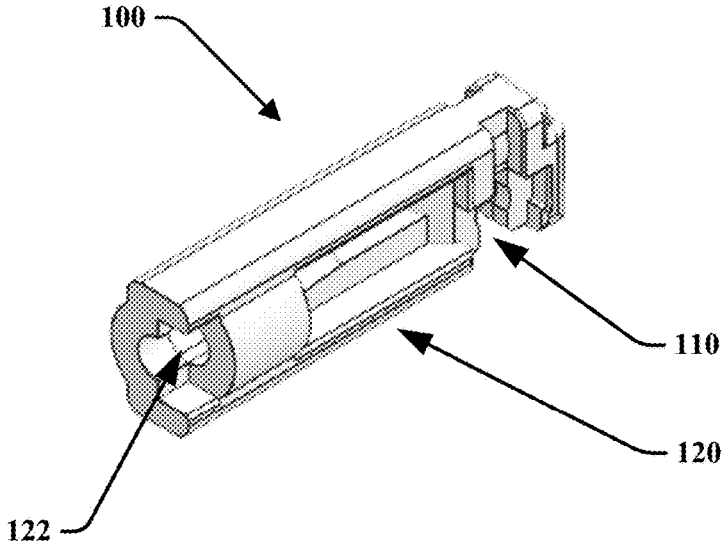
FIGS. 1A-D show various views of an embodiment of a single-arm connector including one arm, wherein the single-arm connector is operatively engageable with another connector or a rod in accordance with aspects disclosed herein.
Figure 1C:
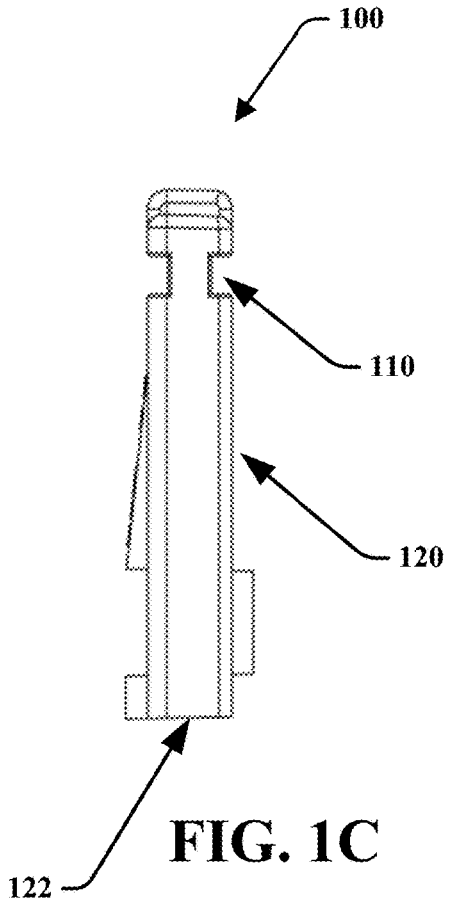
Figure 1B:
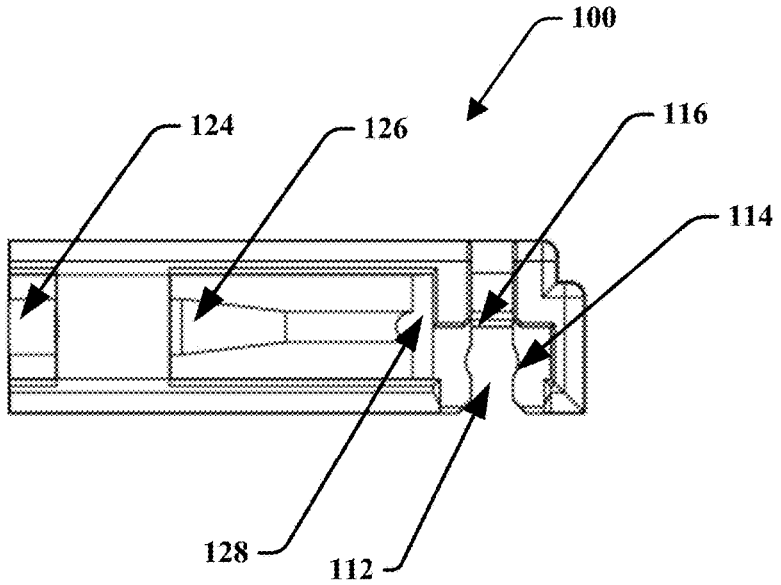
Figure 1D:
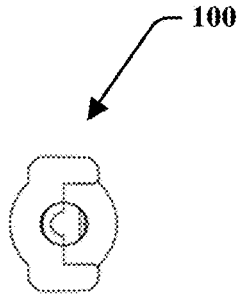
Figure 2A:
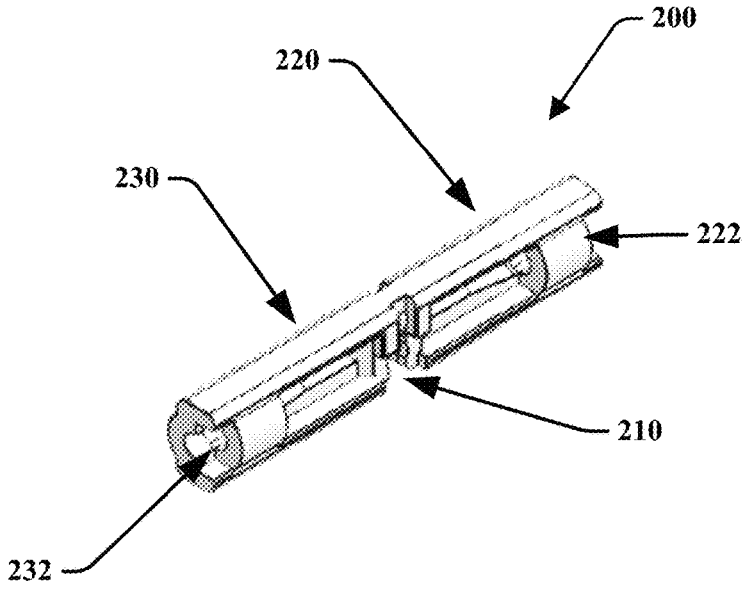
FIGS. 2A-D show various views of an embodiment of a straight connector including two arms, wherein the straight connector is operatively engageable with another connector or a rod in accordance with aspects disclosed herein.
Figure 2C:
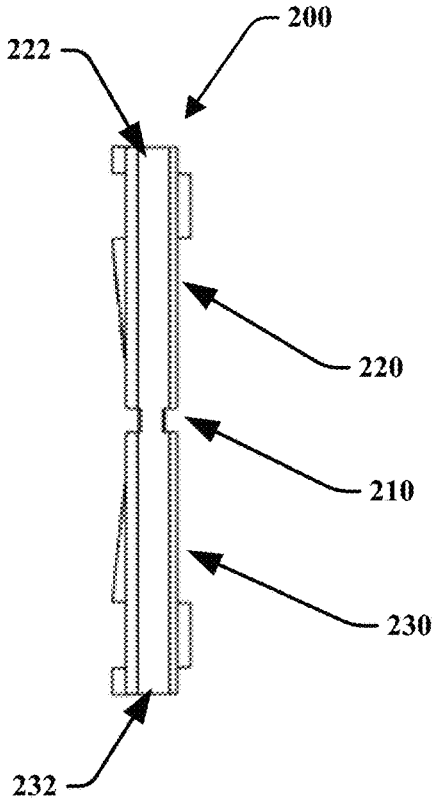
Figure 2B:
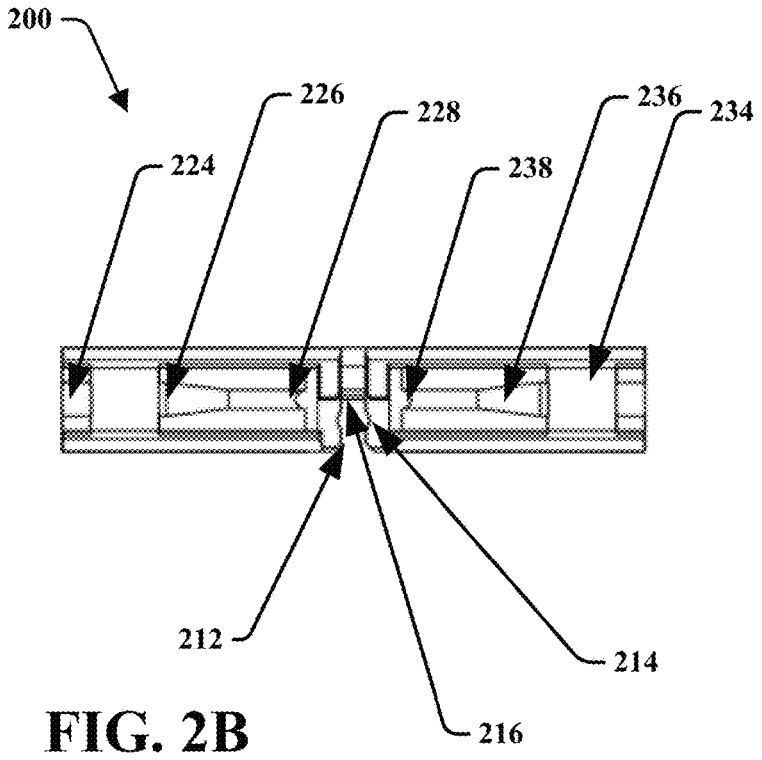
Figure 2D:
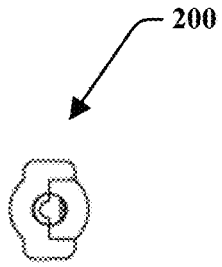
Figure 3A:
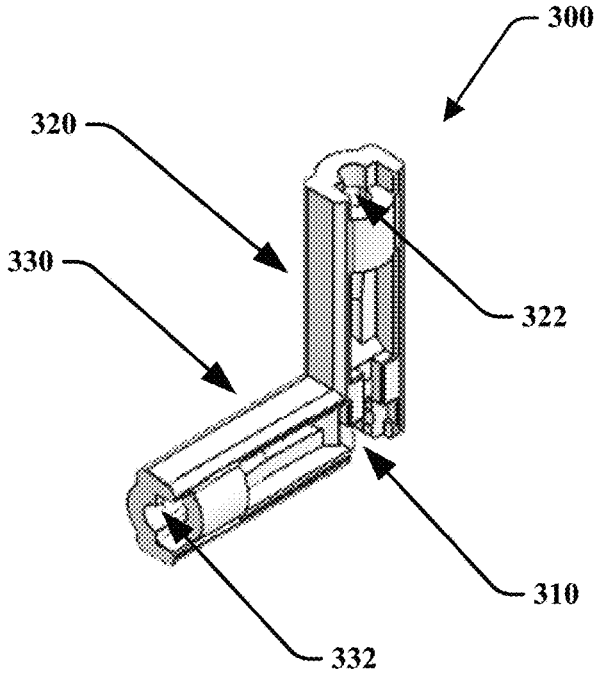
FIGS. 3A-D show various views of an embodiment of a right-angle connector including two arms, wherein the right-angle connector is operatively engageable with another connector or a rod in accordance with aspects disclosed herein.
Figure 3C:
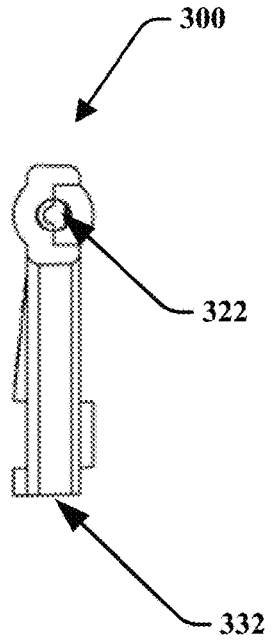
Figure 3B:
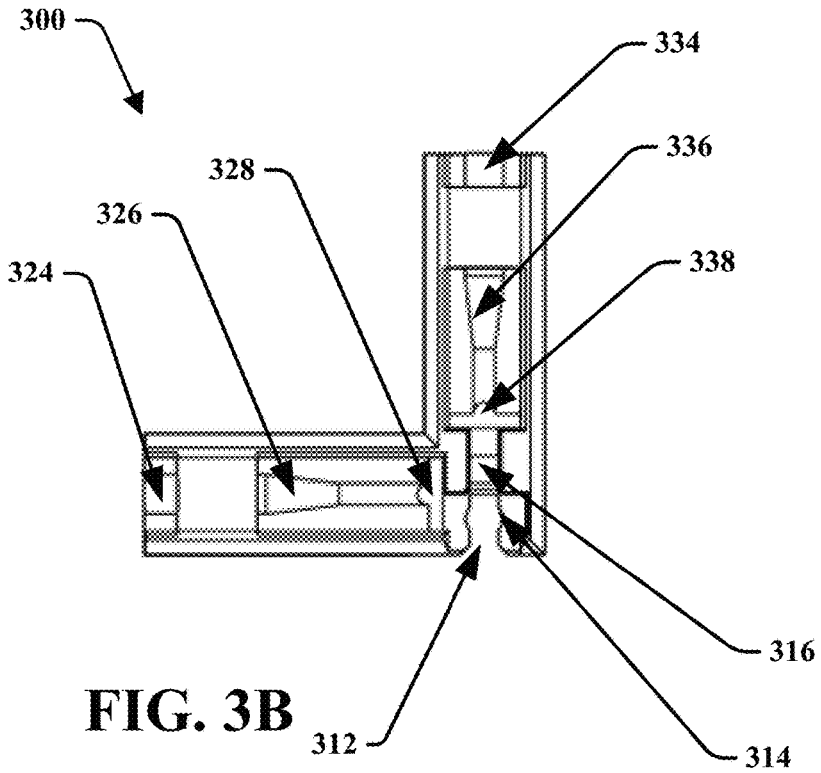
Figure 3D:
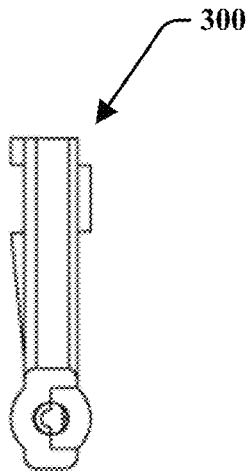
Figure 4A:
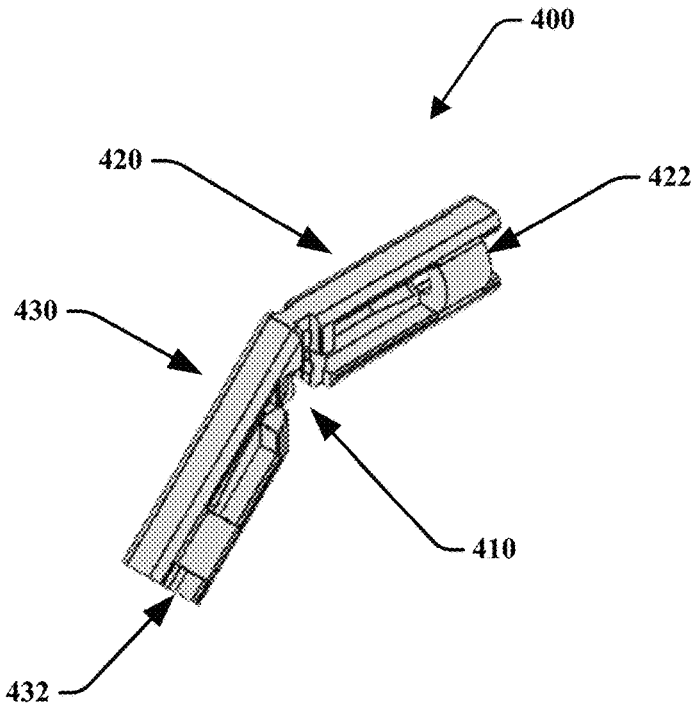
FIGS. 4A-D show various views of an embodiment of an obtuse connector including two arms, wherein the obtuse connector is operatively engageable with another connector or a rod in accordance with aspects disclosed herein.
Figure 4C:
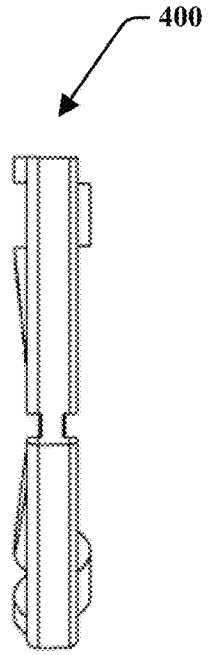
Figure 4B:
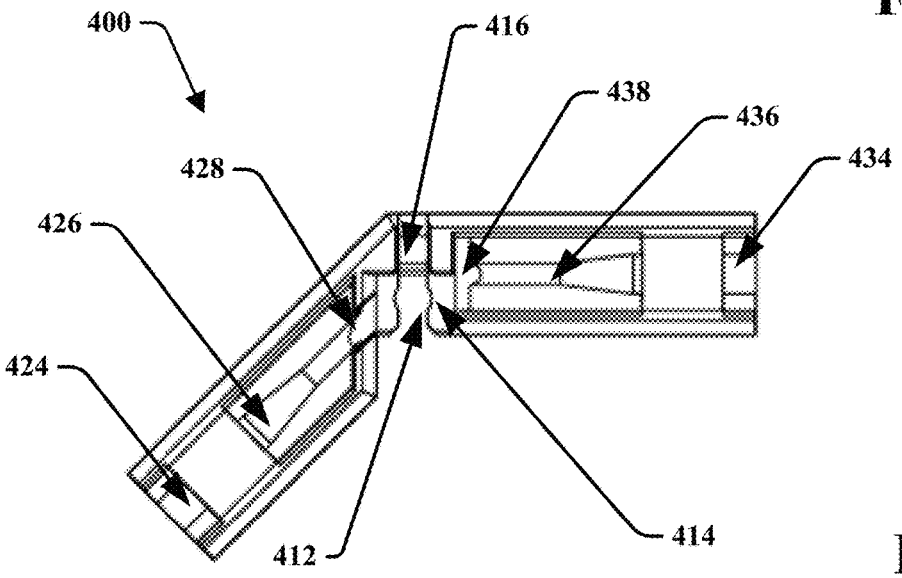
Figure 4D:
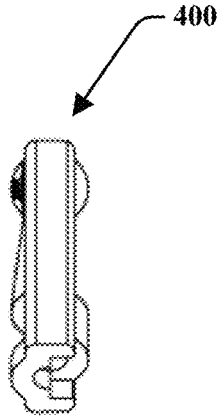
Figure 5A:
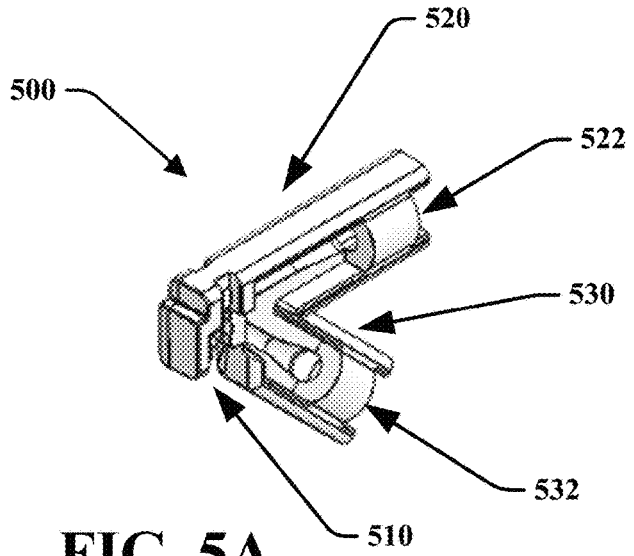
FIGS. 5A-D show various views of an embodiment of an acute connector including two arms, wherein the acute connector is operatively engageable with another connector or a rod in accordance with aspects disclosed herein.
Figure 5C:
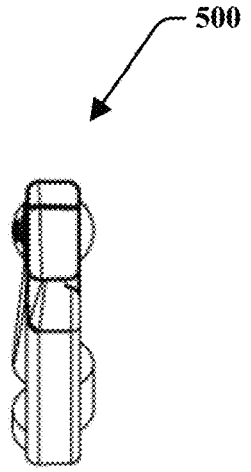
Figure 5B:
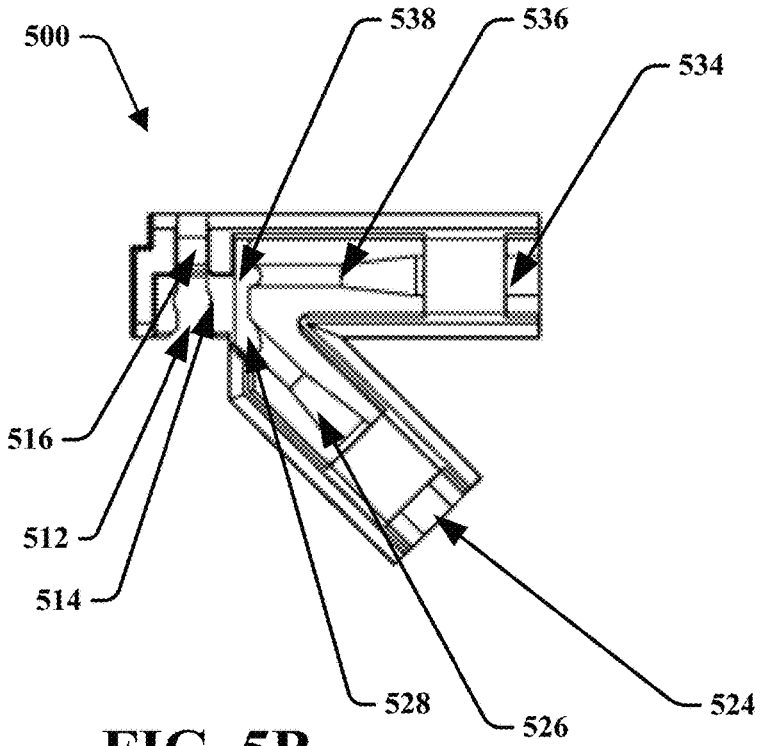
Figure 5D:
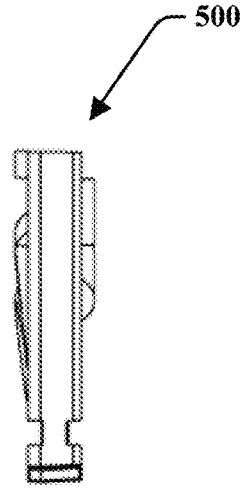
Figure 6A:
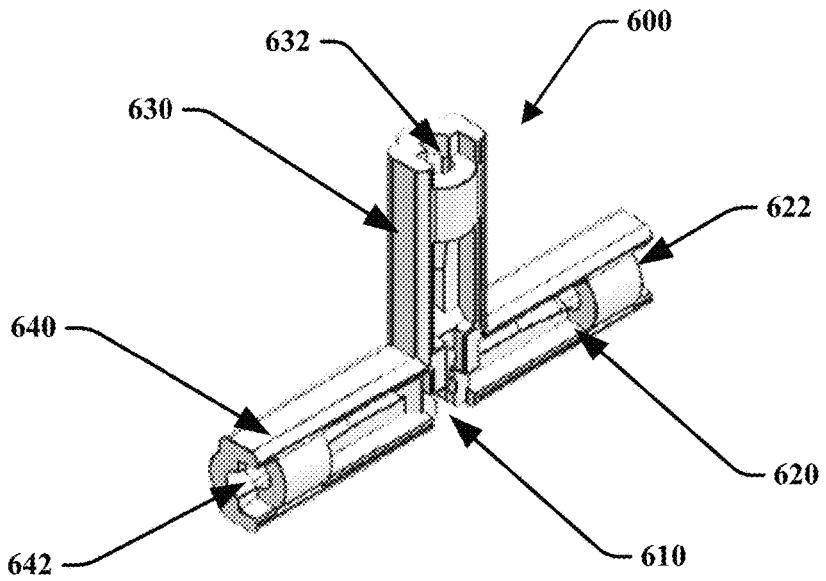
FIGS. 6A-D show various views of an embodiment of a three-arm (or T) connector including three arms, wherein the three-arm connector is operatively engageable with another connector or a rod in accordance with aspects disclosed herein.
Figure 6C:
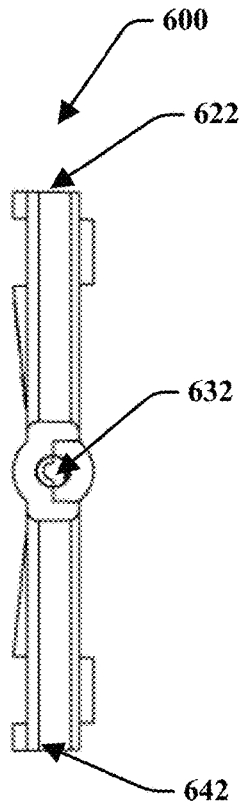
Figure 6B:
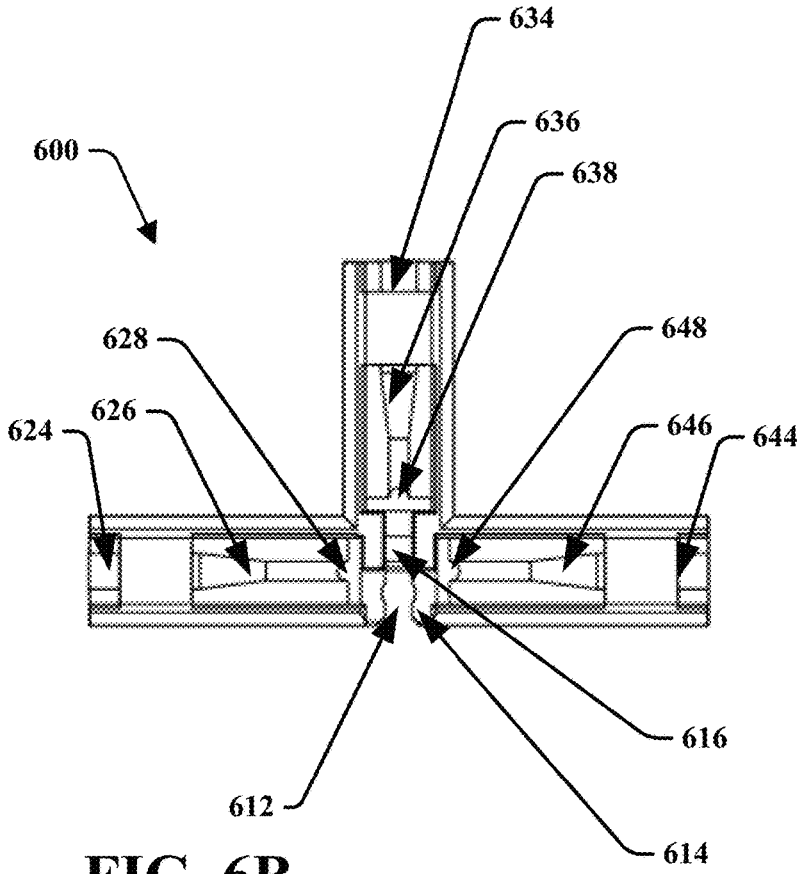
Figure 6D:
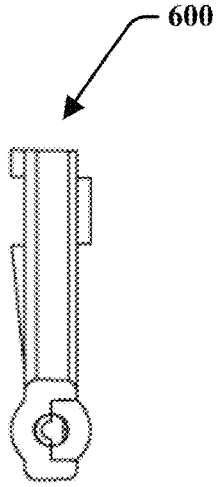
Figure 7A:
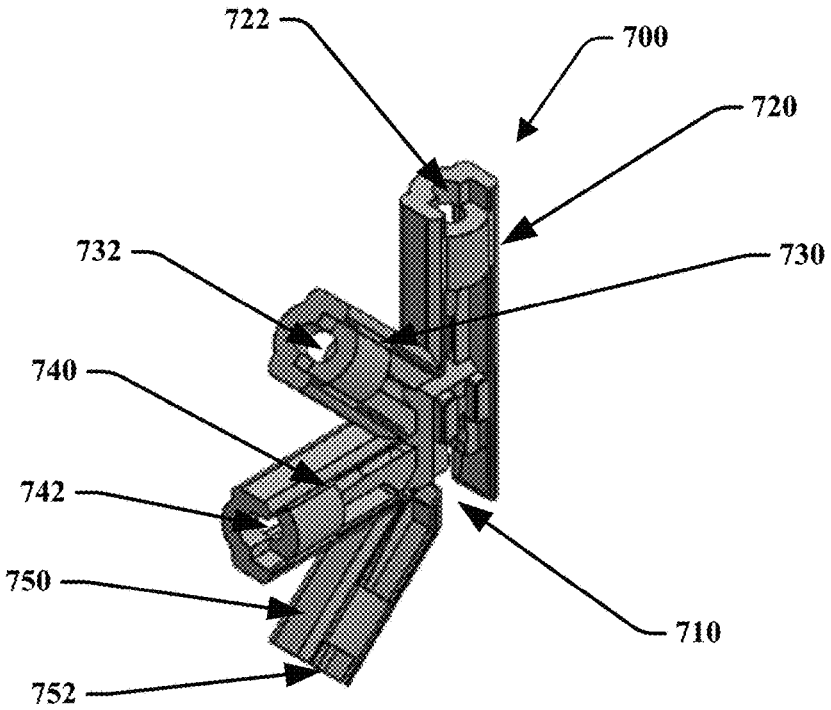
FIGS. 7A-D show various views of an embodiment of a four-arm connector including four arms, wherein the four-arm connector is operatively engageable with another connector or a rod in accordance with aspects disclosed herein.
Figure 7C:
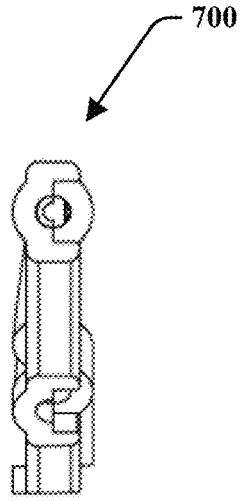
Figure 7B:
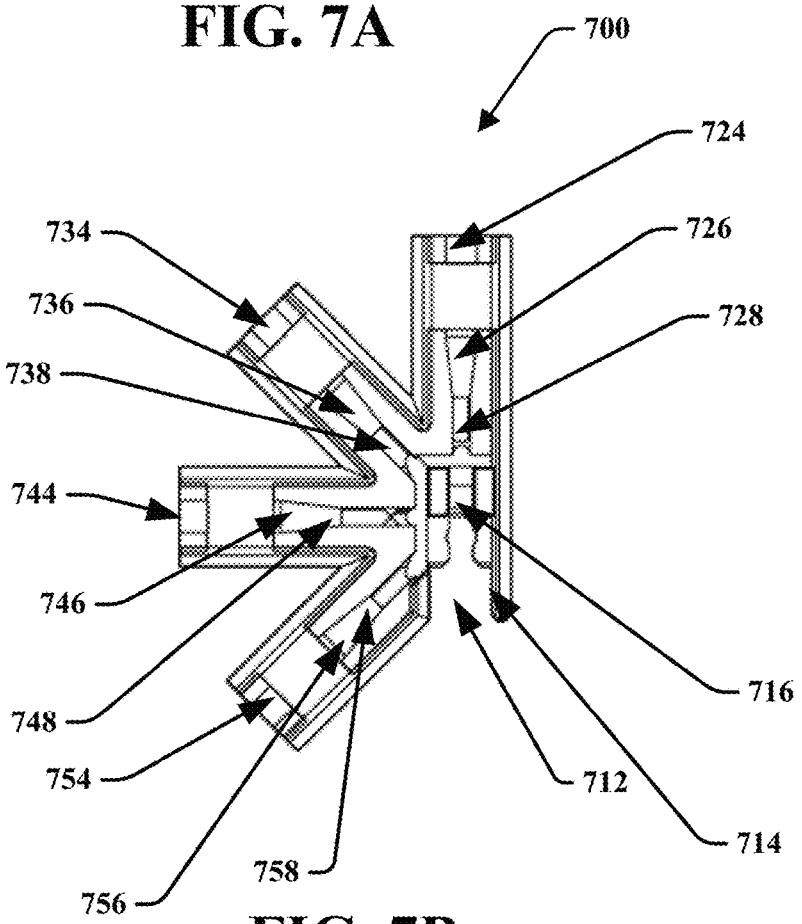
Figure 7D:
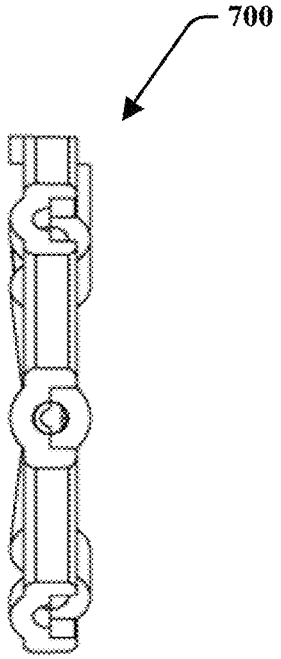

Reference will now be made in detail to exemplary embodiments of the present teachings, examples of which are illustrated in the accompanying drawings. It is to be understood that other embodiments may be utilized and structural and functional changes may be made without departing from the respective scope of the present teachings. Moreover, features of the various embodiments may be combined or altered without departing from the scope of the present teachings. As such, the following description is presented by way of illustration only and should not limit in any way the various alternatives and modifications that may be made to the illustrated embodiments and still be within the spirit and scope of the present teachings. In this disclosure, numerous specific details provide a thorough understanding of the subject disclosure. It should be understood that aspects of this disclosure may be practiced with other embodiments not necessarily including all aspects described herein, etc.

As used herein, the words "example" and "exemplary" means an instance, or illustration. The words "example" or "exemplary" do not indicate a key or preferred aspect or embodiment. The word "or" is intended to be inclusive rather than exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Further, unless context suggest otherwise, descriptions of shapes and angles (e.g., circular, rectangular, triangular, right, obtuse, acute etc.) refer to shapes and angles meeting the definition of such shapes or angles and general representation of such shapes or angles. For instance, a triangular shape or generally triangular shape may include a shape that has three sides and three vertices or a shape that generally represents a triangle, such as a shape having three major sides that may or may not have straight edges, triangular like shapes with rounded vertices, etc. Additionally, referring to a right angle might include angles similar to or about 90°, which may include deviations from such by about one to fifteen degrees. Similarly, comparative lengths (e.g. short, medium, long) may comprise any suitable base length.

While embodiments may refer to a particular example of the described connectors, rods, and building system as having a particular attachment between the connectors and/or rods it is noted that many other orientations and attachments may be possible as all the pieces are interchangeable. While the embodiments may refer to a particular toy application, it is noted that disclosed embodiments may be suitable for users of any age and may be applicable to various other uses, products, and industries. Generally, described embodiments may be utilized for any application that incorporates connectors, rods, tiles, building, crafting, etc. As an example, the building systems may be utilized as 3-D puzzles, as a board game, to build specific instructed shapes or images, as well as freehand building. It is further noted that the connectors, rods, and building system may incorporate or be combined with existing items. For example, the connectors may be adapted to receive plastic or wooden toothpicks, straws, stirrers, and the like.

Components, such as the connectors and rods, may be made of any suitable material including plastics, acrylics, polymers, silicones, and the like. The components may be flexible and malleable, or hard and fixed. In an embodiment, the components may be monolithically formed or formed as separate pieces that are assembled. The components may be 3-D printed utilizing additive manufacturing technics or may be molded, stamped, extruded or manufactured in any known method. The components may include hinges, joints, or pivots that allow rotation or bending. For example, a rod may include a hinge at its center to enable up to a 90° or greater rotation. In another example, a connector may include a hinge at or near its joint to enable rotation between the connectors from an acute to an obtuse angular position. In an embodiment, the components may be rotatable when connected. For example, a mating portion of a rod may be rotatable within a receiving portion of a connector or an axle may be rotatable when operatively connected to a wheel. In an embodiment, the components may be motorized and include a battery, controls, and the like, to build motorized systems. The toy picks building system may be built into a particular shape, item, vehicle, animal, person, building, scene, or landscape. The toy picks building system may also allow for freehand building.

Figure 16:
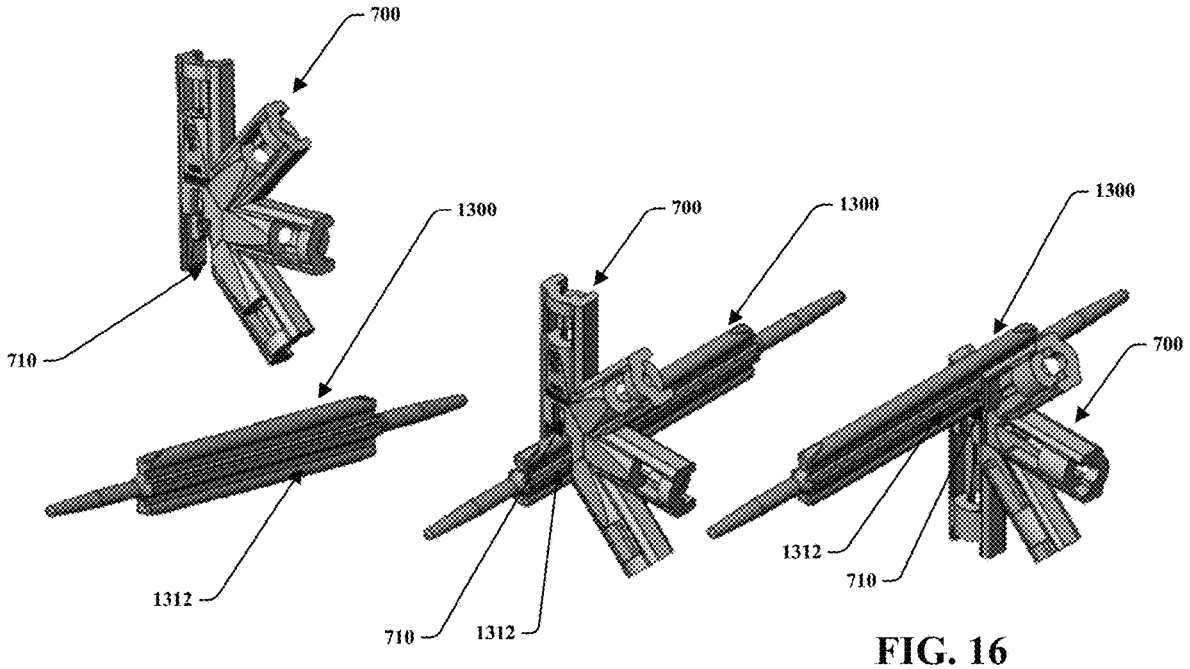
FIG. 16 shows an embodiment of a connection between a rod and a connector in accordance with aspects disclosed herein.
Figure 18:
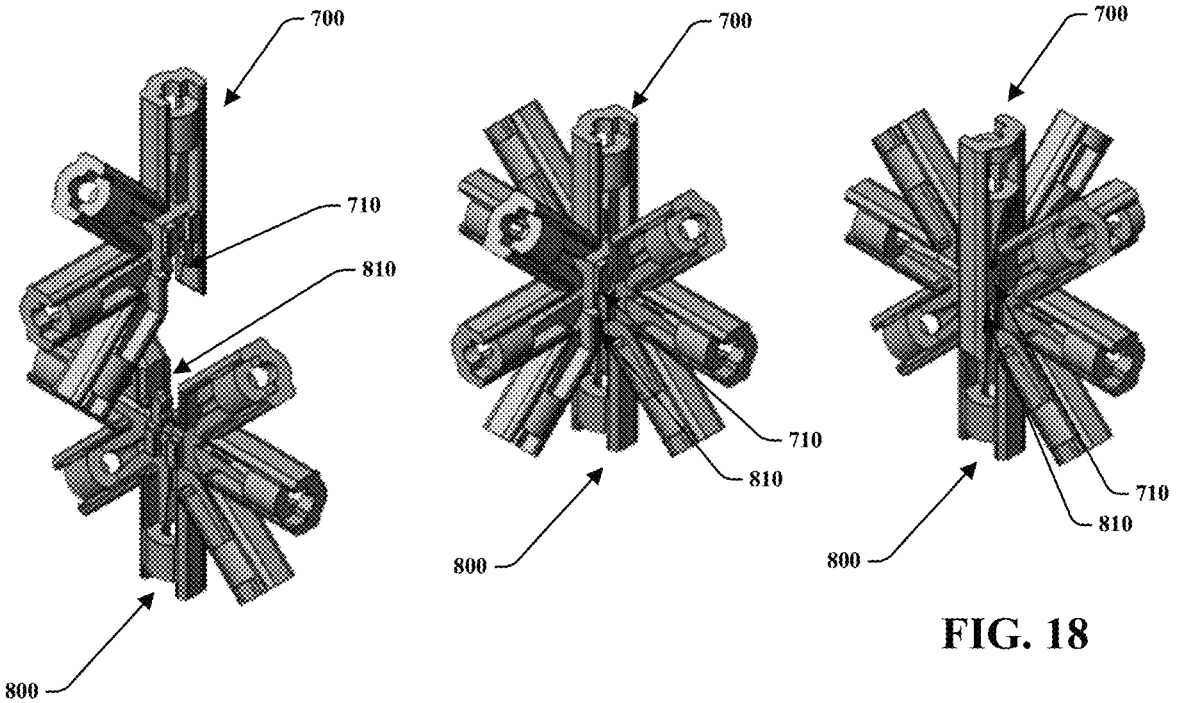

FIGS. 1A-D depict a single-arm connector 100 including a single arm 120. In an embodiment, the single-arm connector 100 may include a first receiving or mating portion 110. In an embodiment, the first receiving portion 110 may be located toward the end of the single-arm connector 100. The first receiving portion 110 may be configured to receive and attach to another connector, such as a second single-arm connector or other connector as disclosed herein (or any other such similar connector not disclosed, but contemplated hereby), including a straight, right angle, acute angle, or obtuse angle connector, or a connector having 3, 4, 5, 6, 7 etc. arms. See, for example, FIG. 18 showing a connection between a four-arm connector and a seven-arm connector—this is representative of how any of the connectors may be connected. The first receiving portion 110 may be configured to receive and attach to a rod, such as short, medium, or long rod, or rod of any desired length or plastic or wooden toothpicks, straws, stirrers, and the like. See, for example, FIG. 16 showing a connection between a four-arm connector and a body of a rod. It is noted that numerous connections between connectors and/or rods (toothpicks, etc.) may also be utilized. For the sake of brevity not every possible combination will be described herein. However, exemplary embodiments are described. These exemplary embodiments are not exhaustive, but are intended to be examples of the present teachings.

In an embodiment, the first receiving portion 110 of the single-arm connector 100 may generally be defined by a recess 112, securing walls 114, and one or more stop points 116. The recess 112 and securing walls 114 of the single-arm connector 100 may attach to or connect to a corresponding mating portion, such as a first receiving portion on a second connector or to a body of a rod as disclosed herein. In an embodiment, the corresponding mating portion of another connector or a rod (and/or toothpick) may first insert into the recess 112, engage a portion of the securing walls 114, and secure a fit with the single-arm connector 100 upon contact with the stop point 116. The recess 112 may include various engagement features such as grooves, ridges, channels, tracks, protrusions, projections, or the like, that correspond to a mating portion of the other connector or rod (and/or toothpick) to create a secure fit. The fit may be a pressure fit, a snap fit, a twist fit, a screw fit, or the like, to enable the operative attachment, detachment, and reattachment of any two pieces of the toy picks building system, which can be utilized to build the final assembly.

The single arm 120 of the single-arm connector 100 may include a second receiving or mating portion 122. In an embodiment, the single arm 120 may be positioned adjacent the first mating portion 110 described above. In an embodiment, the recess 112 of the first receiving portion 110 may be generally perpendicular (e.g., within 1-15 degrees of perpendicular) to the second receiving portion 122 of the single arm 120. The second receiving portion 122 may be configured to receive and attach to a corresponding second mating portion of a rod, see FIG. 17, for example, showing a connection between a three-arm connector and an end of a rod. In an embodiment, the second receiving portion 122 may be configured to receive and attach to an existing item with an elongated portion, such as plastic or wooden toothpicks, straws, stirrers, and the like. For example, the second receiving portion 122 of a connector may attach to either a second mating portion of a rod or an elongated portion of an existing item. The second receiving portion 122 of the single arm 120 may include an opening 124 and generally be defined by an elongated cavity 126 that traverses all or a portion of the length of the single arm 120. The single arm 120 may include a stop point 128 within or at the end of the cavity 126 to prevent further insertion of a rod into the receiving portion 130. The second receiving portion 122 may include various grooves, ridges, channels, tracks, protrusions, projections, or the like, that correspond to a second mating portion of the rod to create a secure fit. The fit may be a pressure fit, a snap fit, a twist fit, a screw fit, or the like, to enable the operative attachment, detachment, and reattachment of a connector and a rod. In an embodiment, the rod is rotatable within the second receiving portion 122 of the connector.

FIGS. 2A-D depict a straight connector 200 including two arms 220, 230. In an embodiment, the straight connector 200 may include a first receiving or mating portion 210. In an embodiment, the first receiving portion 210 may be located in the middle of the straight connector 200, between the two arms 220, 230. As with the other connectors, the first receiving portion 210 may be configured to receive and attach to a corresponding mating portion, such as a first receiving portion on a second connector or to a body of a rod (and/or toothpick) as disclosed herein. In an embodiment, the first receiving portion 210 of the straight connector 200 may generally be defined by a recess 212, securing walls 214, and one or more stop points 216. In an embodiment, the corresponding mating portion of another connector or a rod (and/or toothpick) may first insert into the recess 212, engage a portion of the securing walls 214, and secure a fit with the straight connector 200 upon contact with the stop point 216. The recess 212 may include various engagement features as described herein to create a desired fit and to enable the operative attachment, detachment, and reattachment of any two pieces of the toy picks building system.

The two arms 220, 230 of the straight connector 200 may include second receiving or mating portions 222, 232. In an embodiment, the recess 212 of the first receiving portion 210 may be generally perpendicular (e.g., within 1 to 15 degrees of perpendicular) to the second receiving portions 222, 232 of the two arms 220, 230. The second receiving portions 222, 232 may be configured to receive and attach to a corresponding second mating portion of a rod (and/or toothpick). The second receiving portions 222, 232 of the arms 220, 230 may each include an opening 224, 234 and generally be defined by an elongated cavity 226, 236 that traverses all or a portion of the length of each arm 220, 230. Each arm 220, 230 may include a stop point 228, 238 within or at the end of the cavity 226, 236 to prevent further insertion of a rod (and/or toothpick) into the receiving portion 222, 232. The second receiving portions 222, 232 may include various engagement features as described herein to create a desired fit and to enable the operative attachment, detachment, and reattachment of a connector and a rod (and/or toothpick) to build the assembly desired.

FIGS. 3A-D depict a right-angle connector 300 including two arms 320, 330 at a generally right angle (e.g., within 1 to 15 degrees of 90 degrees). In an embodiment, the right-angle connector 300 may include a first receiving or mating portion 310. In an embodiment, the first receiving portion 310 may be located in the middle (or generally in the middle, e.g., slightly skewed to each side thereof) of the right-angle connector 300, between the two arms 320, 330. As with the other connectors, the first receiving portion 310 may be configured to receive and attach to a corresponding mating portion, such as a first receiving portion on a second connector or to a body of a rod (and/or toothpick) as disclosed herein. In an embodiment, the first receiving portion 310 of the right-angle connector 300 may generally be defined by a recess 312, securing walls 314, and one or more stop points 316. In an embodiment, the corresponding mating portion of another connector or a rod (and/or toothpick) may first insert into the recess 312, engage a portion of the securing walls 314, and secure a fit with the right-angle connector 300 upon contact with the stop point 316. The recess 312 may include various engagement features as described herein to create a desired fit and to enable the operative attachment, detachment, and reattachment of any two pieces of the toy picks building system.

The two arms 320, 330 of the right-angle connector 300 may include second receiving or mating portions 322, 332. In an embodiment, the recess 312 of the first receiving portion 310 may be perpendicular to the second receiving portions 332 of one arm 330, and in line with the receiving portion 322 of the other arm 320. The second receiving portions 322, 332 may be configured to receive and attach to a corresponding second mating portion of a rod (and/or toothpick). The second receiving portions 322, 332 of the arms 320, 330 may each include an opening 324, 334 and generally be defined by an elongated cavity 326, 336 that traverses all or a portion of the length of each arm 320, 330. Each arm 320, 330 may include a stop point 328, 338 within or at the end of the cavity 326, 336 to prevent further insertion of a rod (and/or toothpick) into the receiving portion 322, 332. The second receiving portions 322, 332 may include various engagement features as described herein to create a desired fit and to enable the operative attachment, detachment, and reattachment of a connector and a rod (and/or toothpick).

FIGS. 4A-D depict an obtuse-angle connector 400 including two arms 420, 430 at an obtuse angle relative to one another (e.g., the angle between the two arms 420, 430 is greater than 90 degrees and may be for example 135 degrees). In an embodiment, the obtuse-angle connector 400 may include a first receiving or mating portion 410. In an embodiment, the first receiving portion 410 may be located in the middle or generally near the middle of the obtuse-angle connector 400, between the two arms 420, 430. As with the other connectors, the first receiving portion 410 may be configured to receive and attach to a corresponding mating portion, such as a first receiving portion on a second connector or to a body of a rod (and/or toothpick) as disclosed herein. In an embodiment, the first receiving portion 410 of the obtuse-angle connector 400 may generally be defined by a recess 412, securing walls 414, and one or more stop points 416. In an embodiment, the corresponding mating portion of another connector or a rod (and/or toothpick) may first insert into the recess 412, engage a portion of the securing walls 414, and secure a fit with the obtuse-angle connector 400 upon contact with the stop point 416. The recess 412 may include various engagement features as described herein to create a desired fit and to enable the operative attachment, detachment, and reattachment of any two pieces of the toy picks building system.

The two arms 420, 430 of the obtuse-angle connector 400 may include second receiving or mating portions 422, 432. The second receiving portions 422, 432 may be configured to receive and attach to a corresponding second mating portion of a rod (and/or toothpick). The second receiving portions 422, 432 of the arms 420, 430 may each include an opening 424, 434 and generally be defined by an elongated cavity 426, 436 that traverses all or a portion of the length of each arm 420, 430. Each arm 420, 430 may include a stop point 428, 438 within or at the end of the cavity 426, 436 to prevent further insertion of a rod into the receiving portion 422, 432. The second receiving portions 422, 432 may include various engagement features as described herein to create a desired fit and to enable the operative attachment, detachment, and reattachment of a connector and a rod (and/or toothpick).

FIGS. 5A-D depict an acute-angle connector 500 including two arms 520, 530 at an acute angle relative to each other (e.g., the angle between the arms 520, 530 is less than 90 degrees, for example 45 degrees). In an embodiment, the acute-angle connector 500 may include a first receiving or mating portion 510. In an embodiment, the first receiving portion 510 may be located in the middle of the acute-angle connector 500, between the two arms 520, 530. As with the other connectors, the first receiving portion 510 may be configured to receive and attach to a corresponding mating portion, such as a first receiving portion on a second connector or to a body of a rod (and/or toothpick) as disclosed herein. In an embodiment, the first receiving portion 510 of the acute-angle connector 500 may generally be defined by a recess 512, securing walls 514, and one or more stop points 516. In an embodiment, the corresponding mating portion of another connector or a rod may first insert into the recess 512, engage a portion of the securing walls 514, and secure a fit with the acute-angle connector 500 upon contact with the stop point 516. The recess 512 may include various engagement features as described herein to create a desired fit and to enable the operative attachment, detachment, and reattachment of any two pieces of the toy picks building system.

The two arms 520, 530 of the acute-angle connector 500 may include second receiving or mating portions 522, 532. The second receiving portions 522, 532 may be configured to receive and attach to a corresponding second mating portion of a rod (and/or toothpick). The second receiving portions 522, 532 of the arms 520, 530 may each include an opening 524, 534 and generally be defined by an elongated cavity 526, 536 that traverses all or a portion of the length of each arm 520, 530. Each arm 520, 530 may include a stop point 528, 538 within or at the end of the cavity 526, 536 to prevent further insertion of a rod (and/or toothpick) into the receiving portion 522, 532. The second receiving portions 522, 532 may include various engagement features as described herein to create a desired fit and to enable the operative attachment, detachment, and reattachment of a connector and a rod (and/or toothpick).

FIGS. 6A-D depict a three-arm connector 600 including three arms 620, 630, 640 in the same 2-D plane, in an x, y, and −x directions (which may form a generally T-shape). It is noted, however, that the three arms 620, 630, 640 may also be oriented in a 3-D configuration in the x, y, and z directions. In an embodiment, the three-arm connector 600 may include a first receiving or mating portion 610. In an embodiment, the first receiving portion 610 may be located at the joint of the three-arm connector 600, where the three arms 620, 630, 640 join. As with the other connectors, the first receiving portion 610 may be configured to receive and attach to a corresponding mating portion, such as a first receiving portion on a second connector or to a body of a rod (and/or toothpick) as disclosed herein. In an embodiment, the first receiving portion 610 of the three-arm connector 600 may generally be defined by a recess 612, securing walls 614, and one or more stop points 616. In an embodiment, the corresponding mating portion of another connector or a rod (and/or toothpick) may first insert into the recess 612, engage a portion of the securing walls 614, and secure a fit with the three-arm connector 600 upon contact with the stop point 616. The recess 612 may include various engagement features as described herein to create a desired fit and to enable the operative attachment, detachment, and reattachment of any two pieces of the toy picks building system.

The three arms 620, 630, 640 of the three-arm connector 600 may include second receiving or mating portions 622, 632, 642. In an embodiment, the recess 612 of the first receiving portion 610 may be generally perpendicular (e.g., 1 to 15 degrees of perpendicular) to the second receiving portions 622, 642 of two arms 620, 640, and in line with the receiving portion 633 of the other arm 630. The second receiving portions 622, 632, 642 may be configured to receive and attach to a corresponding second mating portion of a rod (and/or toothpick). The second receiving portions 622, 632, 642 of the arms 620, 630, 640 may each include an opening 624, 634, 644 and generally be defined by an elongated cavity 626, 636, 646 that traverses all or a portion of the length of each arm 620, 630, 640. Each arm 620, 630, 640 may include a stop point 628, 638, 648 within or at the end of the cavity 626, 636, 646 to prevent further insertion of a rod (and/or toothpick) into the receiving portion 622, 632, 642. The second receiving portions 622, 632, 642 may include various engagement features as described herein to create a desired fit and to enable the operative attachment, detachment, and reattachment of a connector and a rod (and/or toothpick).

FIGS. 7A-D depict a four-arm connector 700 including four arms 720, 730, 740, 750 in the same 2-D plane. It is noted, however, that the four arms 720, 730, 740, 750 may also be oriented in a 3-D configuration in any of the x, y, and z directions. In an embodiment, the four-arm connector 700 may include a first receiving or mating portion 710. In an embodiment, the first receiving portion 710 may be located at the joint of the four-arm connector 700, where the four arms 720, 730, 740, 750 join. As with the other connectors, the first receiving portion 710 may be configured to receive and attach to a corresponding mating portion, such as a first receiving portion on a second connector or to a body of a rod (and/or toothpick) as disclosed herein. In an embodiment, the first receiving portion 710 of the four-arm connector 700 may generally be defined by a recess 712, securing walls 714, and one or more stop points 716. In an embodiment, the corresponding mating portion of another connector or a rod may first insert into the recess 712, engage a portion of the securing walls 714, and secure a fit with the four-arm connector 700 upon contact with the stop point 716. The recess 712 may include various engagement features as described herein to create a desired fit and to enable the operative attachment, detachment, and reattachment of any two pieces of the toy picks building system.

The four arms 720, 730, 740, 750 of the three-arm connector 600 may include second receiving or mating portions 722, 732, 742, 752. The second receiving portions 722, 732, 742, 752 may be configured to receive and attach to a corresponding second mating portion of a rod (and/or toothpick). The second receiving portions 722, 732, 742, 752 of the four arms 720, 730, 740, 750 may each include an opening 724, 734, 744, 754 and generally be defined by an elongated cavity 726, 736, 746, 756 that traverses all or a portion of the length of each arm 720, 730, 740, 750. Each arm 720, 730, 740, 750 may include a stop point 728, 738, 748, 758 within or at the end of the cavity 726, 736, 746, 756 to prevent further insertion of a rod (and/or toothpick) into the receiving portion 722, 732, 742, 752. The second receiving portions 722, 732, 742, 752 may include various engagement features as described herein to create a desired fit and to enable the operative attachment, detachment, and reattachment of a connector and a rod (and/or toothpick).

Figure 8A:
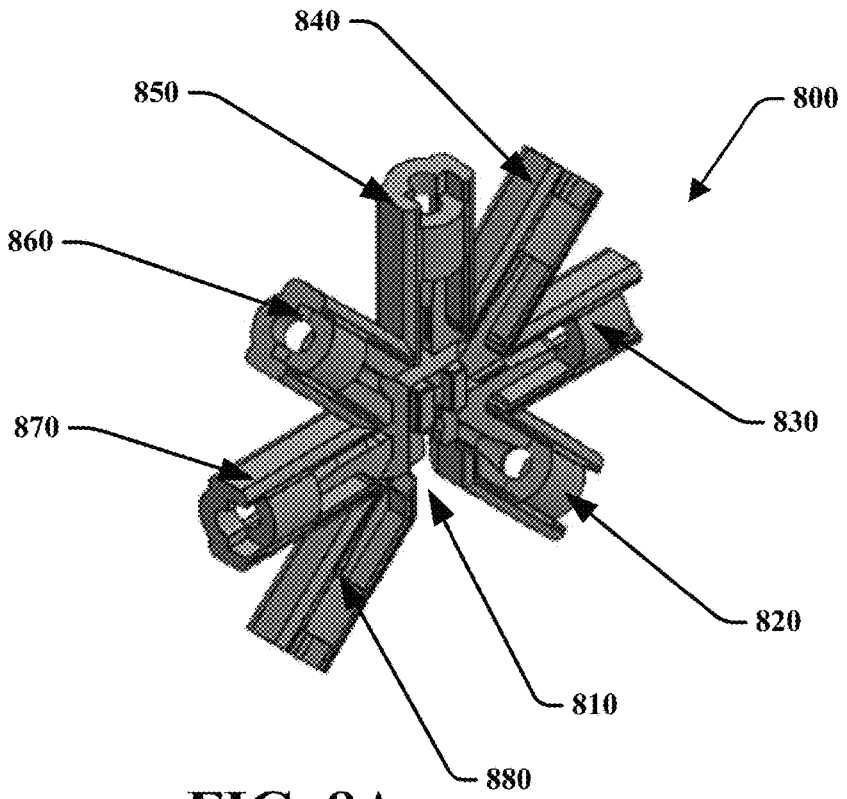
FIGS. 8A-C show various views of an embodiment of a seven-arm connector including seven arms, wherein the seven-arm connector is operatively engageable with another connector or a rod in accordance with aspects disclosed herein.
Figure 8C:
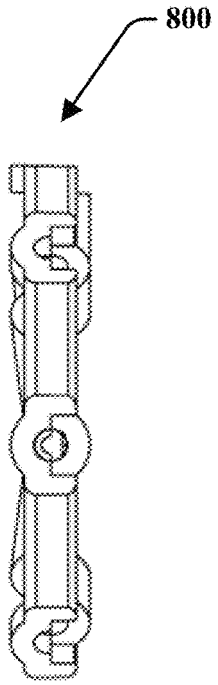
Figure 8B:
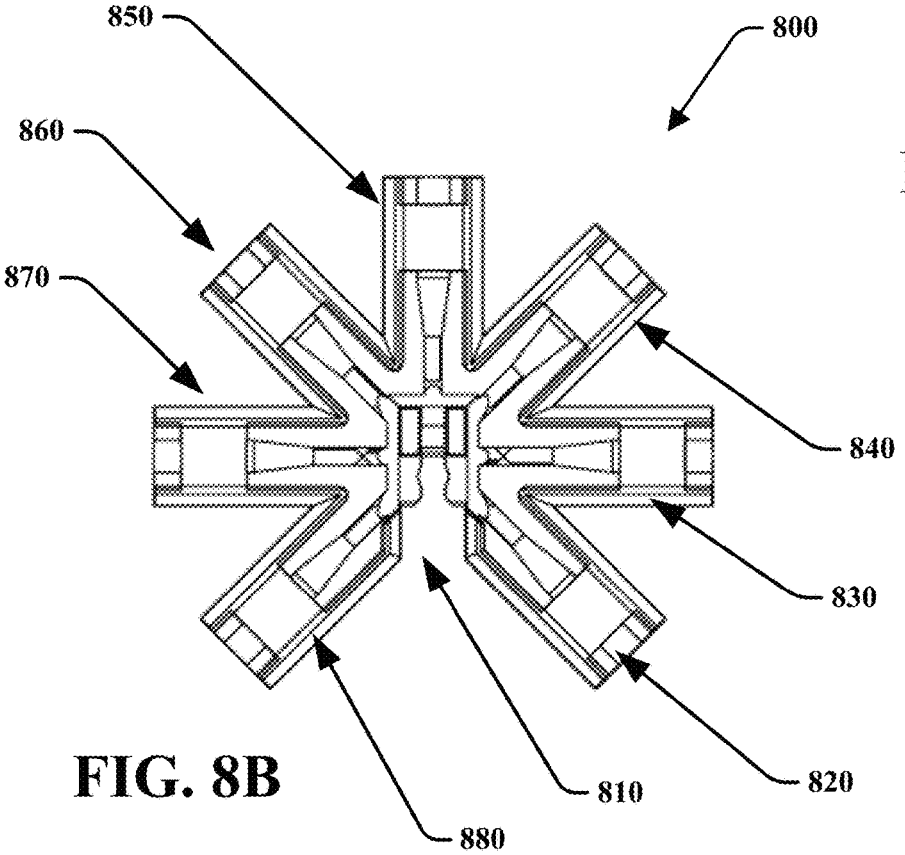
Figure 15:
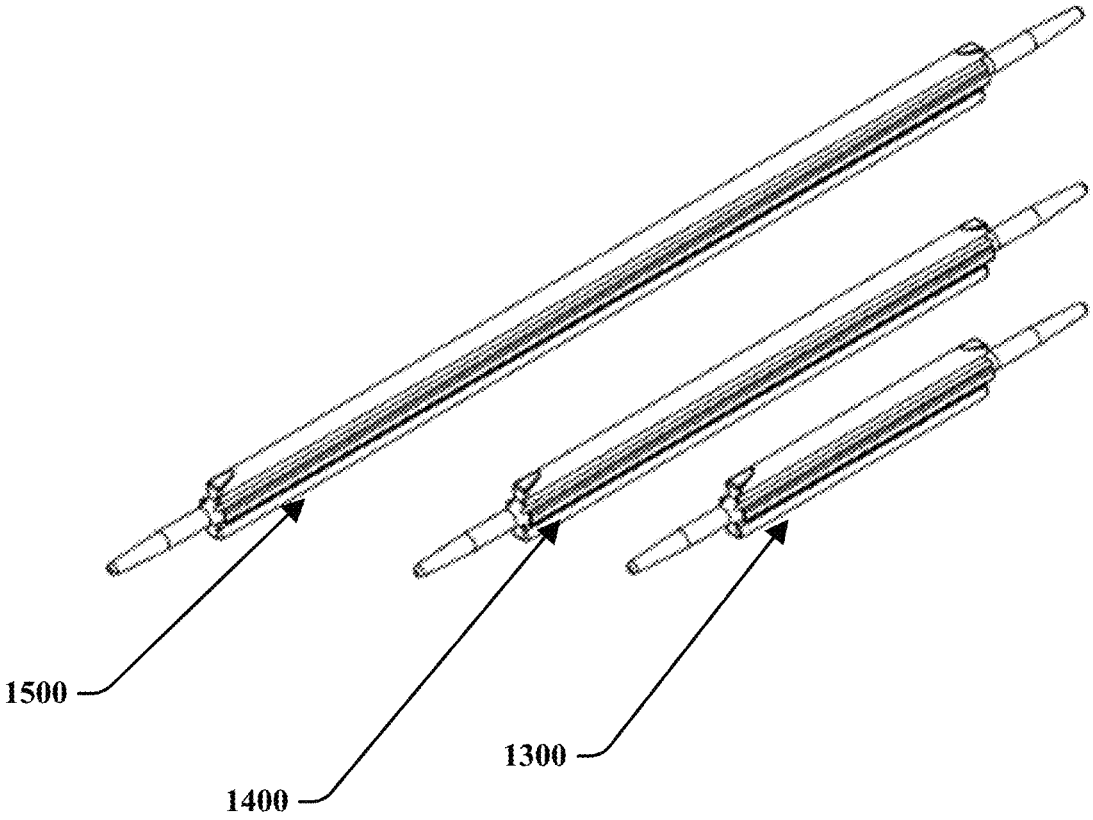
FIG. 15 shows embodiments of the short, medium, and long rods of FIGS. 10-11 in accordance with aspects disclosed herein.

FIG. 8A-C depict a seven-arm connector 800 including seven arms 820, 830, 840, 850, 860, 870, 880 in the same 2-D plane. It is noted, however, that the four arms 720, 730, 740, 750 may also be oriented in a 3-D configuration in any of the x, y, and z directions. It is further noted that connectors may include 5 arms, or other numbers of arms including 8, 9, 10, etc. The seven-arm connector 800, and others having varying number and orientations of arms, may generally include similar aspects including a first receiving portion adapted to receive a first receiving portion on a second connector, as shown in FIG. 16, or a body of a rod (and/or toothpick), as shown in FIG. 14. The seven-arm connector 800, and others, may further include x number of arms where x is an integer. In the seven-arm connector 800, seven arms may be included. These arms may include second receiving portions that are adapted to receive the end of a rod (and/or toothpick), for example, as shown in FIG. 15. The internal structures of the first receiving portions and each of the second receiving portions may be similar or different, but, in an embodiment, may include engagement features to secure various pieces of the toy picks building system together and enable the operative attachment, detachment, and reattachment of the pieces.

Figure 9A:
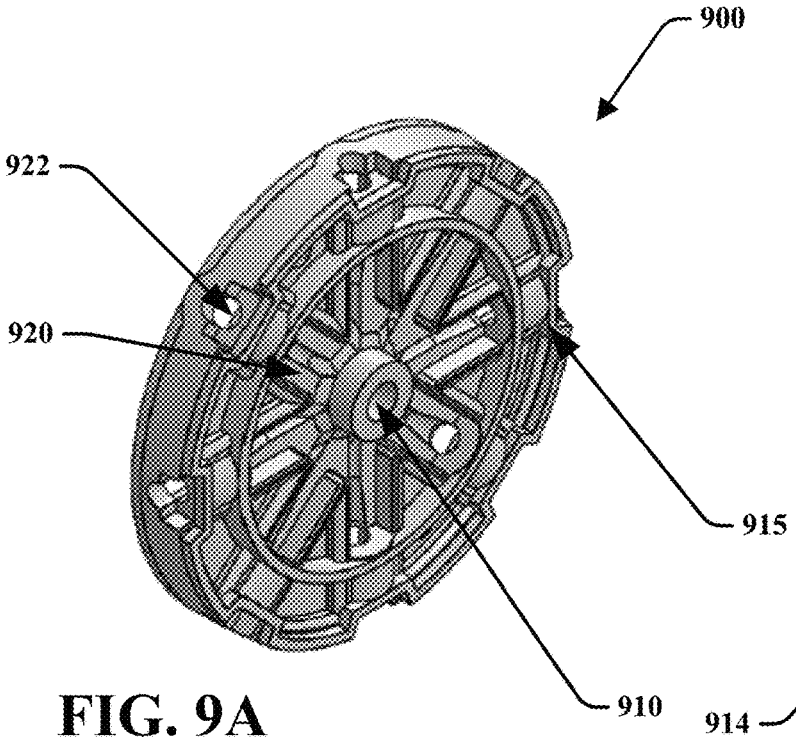
FIGS. 9A-C show various views of an embodiment of a wheel connector including eight arms, wherein the wheel connector is operatively engageable with another connector or a rod in accordance with aspects disclosed herein.
Figure 9C:
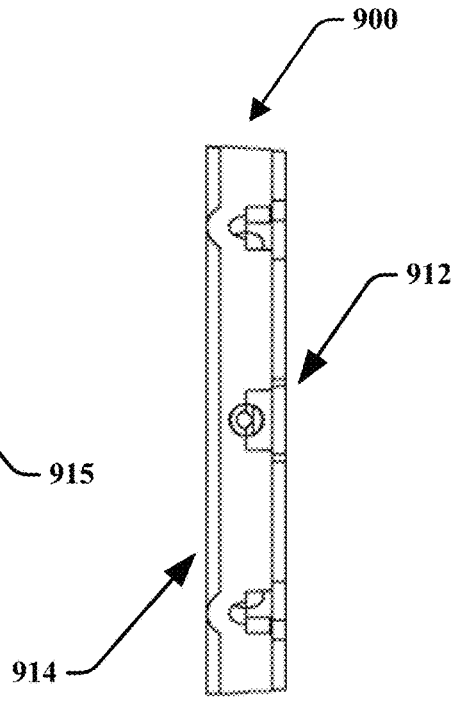
Figure 9B:
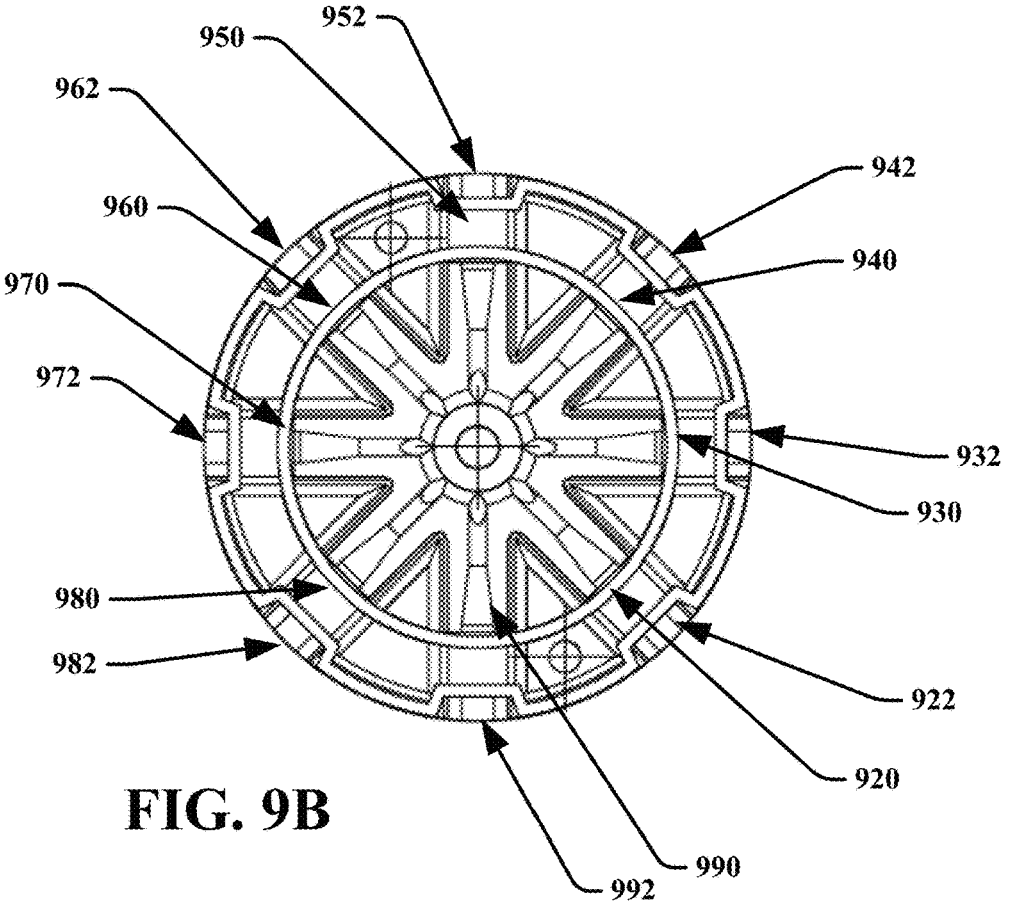

FIGS. 9A-C depict an embodiment of a wheel connector 900. The wheel connector 900 may include a hub or first receiving portion 910, a rim, 915, and a plurality of arms, such as eight arms 920, 930, 940, 950, 960, 970, 980, 990. As shown in FIG. 9C, the wheel connector 900 may generally form a planar shape where the plurality of arms may be positioned in the same 2-D plane and at a substantially similar angle from one another to generally comprise a circle. It is noted, however, that the eight arms may also be oriented in a 3-D configuration in any of the x, y, and z directions, in which case the arms may not generally form a circle or a wheel. In an embodiment, a multitude of arms may be oriented so as to comprise a sphere with arms projecting in all directions not just the eight shown. For example, the wheel connector 900 may include x number of arms where x is an integer, e.g., two, three, four, five, six, seven, nine, ten, etc. The wheel connector 900 may include a first receiving portion 910 that, in an embodiment, may include a circular projection. The first receiving portion 910 may be located on a first face 912 of the wheel connector 900. The first receiving portion 910 may correspond to a mating portion located on the second face 914 of the wheel connector 900 so that two wheels may be connected together. It is noted that similar mating portions may be included on any of the connectors to serve as an attachment point between the wheel and a rod (and/or toothpick) or other connector. In an embodiment, the wheel connector 900 may further include a rim piece 915 that circumscribes the circular shape of the arms.

The arms 920, 930, 940, 950, 960, 970, 980, 990 of the wheel connector 900 may each include similar second receiving portions 922, 932, 942, 952, 962, 972, 982, 992 as have been described herein. The second receiving portions 922, 932, 942, 952, 962, 972, 982, 992 may be adapted to receive the end of a rod (and/or toothpick), for example, and may generally comprise engagement features within to operatively enable attachment between the wheel connector 900 and other components of the toy picks building system.

Figure 10A:
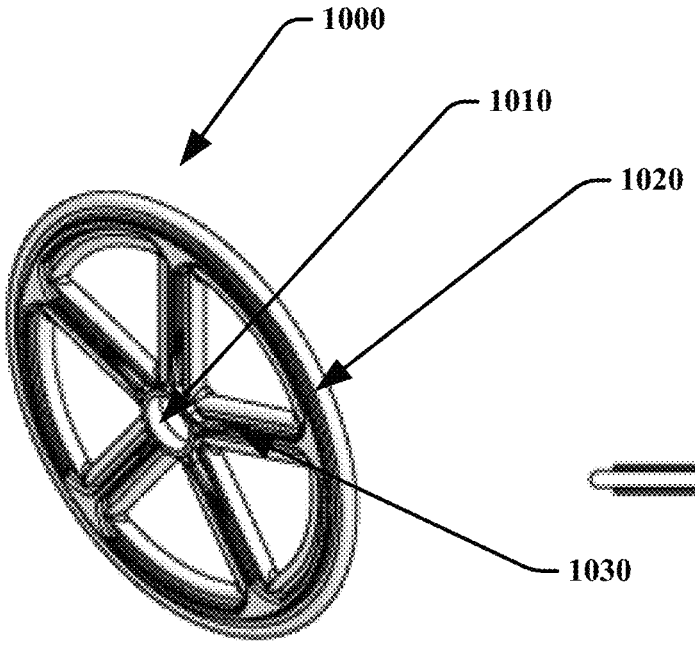
FIGS. 10A-D show various views of an embodiment of a second wheel connector, wherein the second wheel connector is operatively engageable with another connector or a rod in accordance with aspects disclosed herein.
Figure 10C:
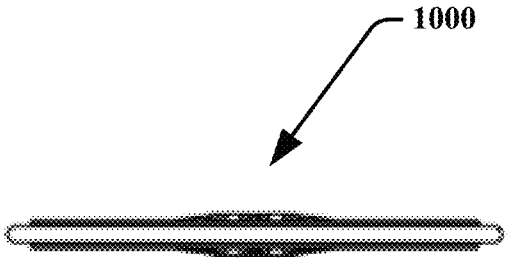
Figure 10B:
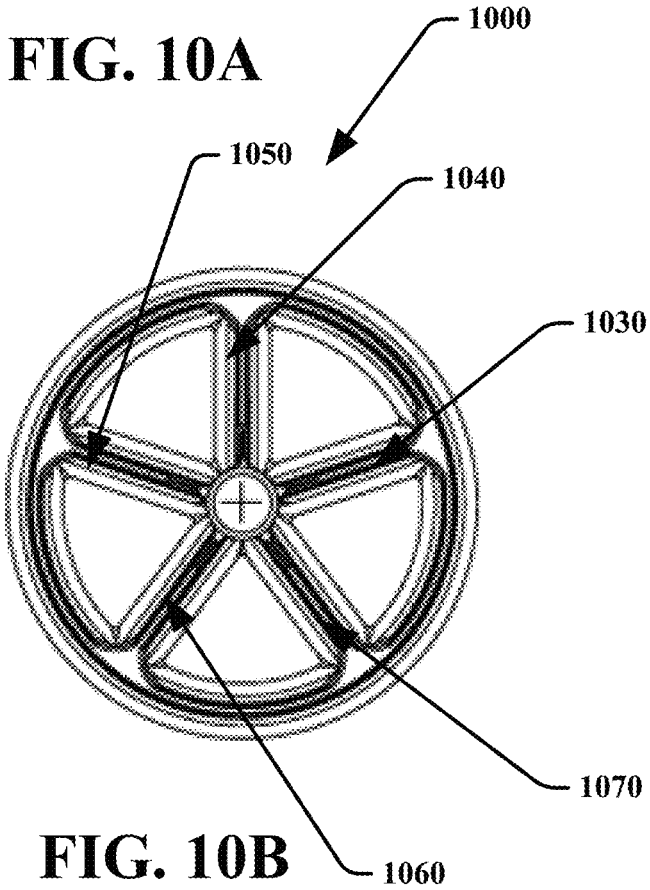
Figure 10D:
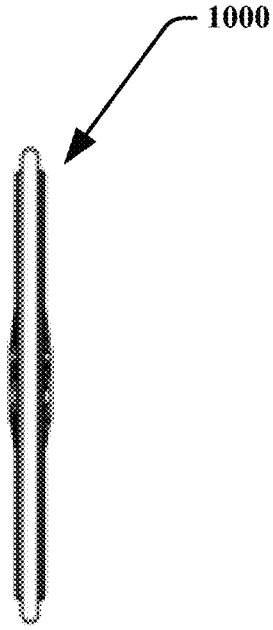
Figure 11A:
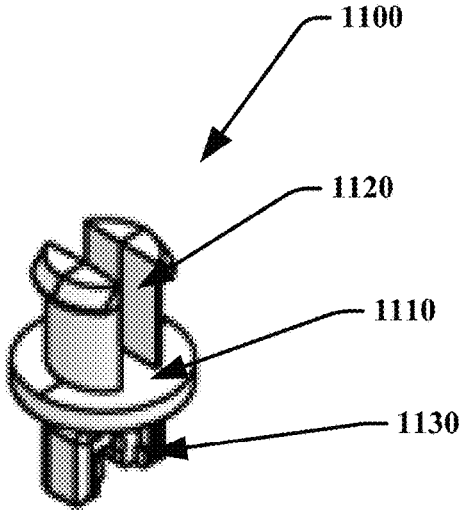
FIGS. 11A-D various views of an embodiment of an axle, wherein the second wheel connector is operatively engageable with the first or second wheel connector or other connector in accordance with aspects disclosed herein.
Figure 11C:
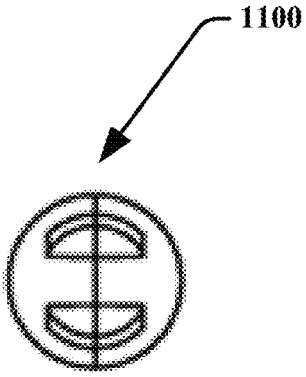
Figure 11B:
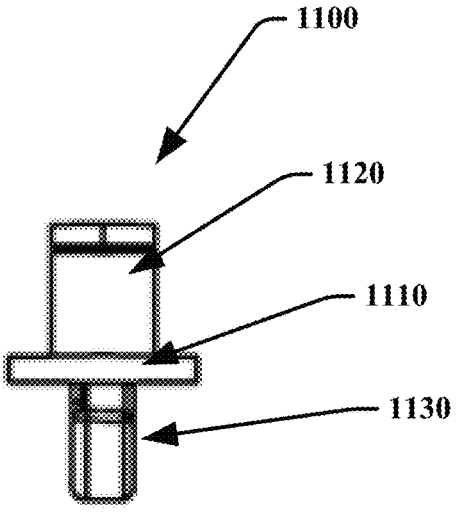
Figure 11D:
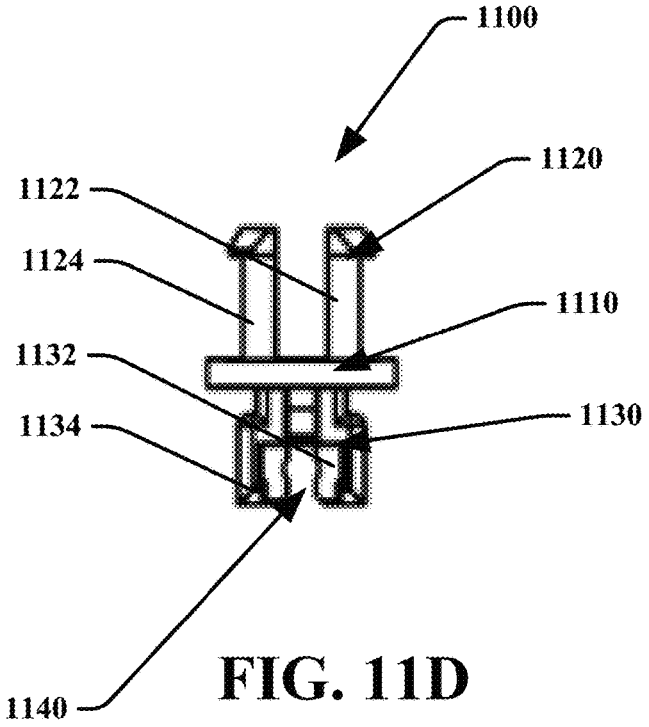
Figure 12A:
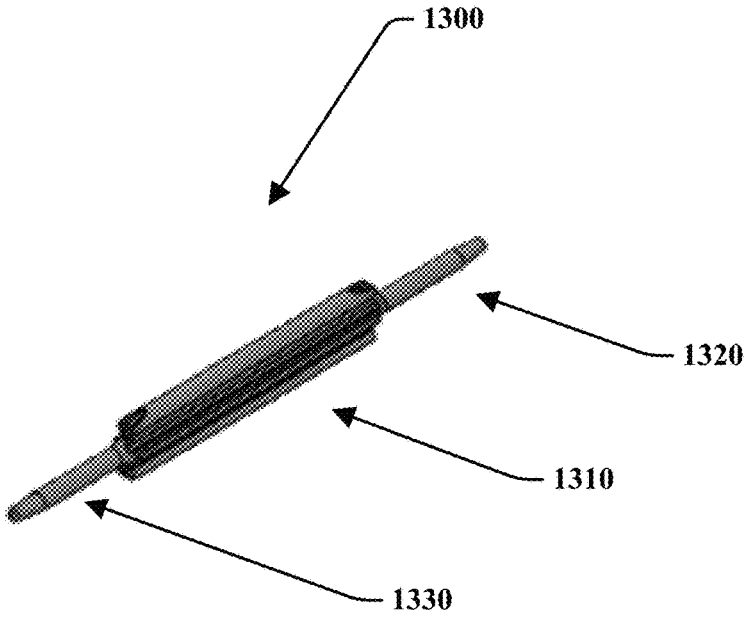
FIGS. 12A-D show various views of an embodiment of a short rod operatively engageable with a connector or another rod in accordance with aspects disclosed herein.
Figure 12C:
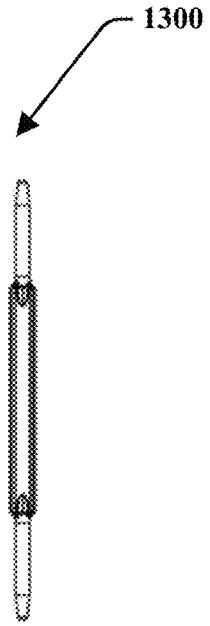
Figure 12B:
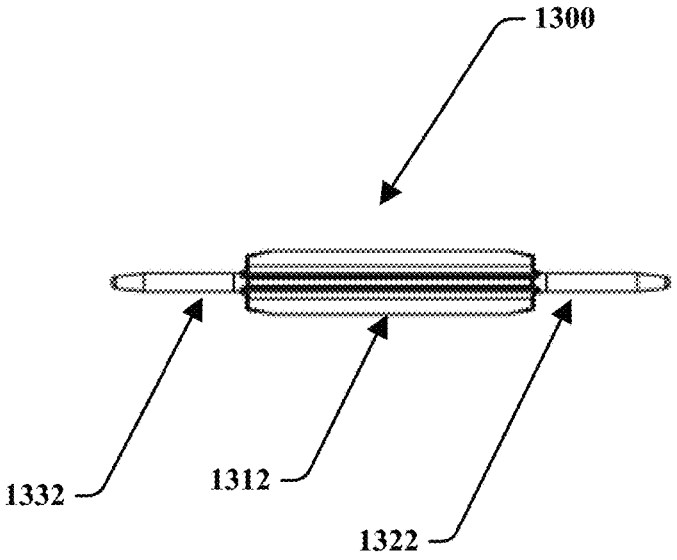
Figure 12D:
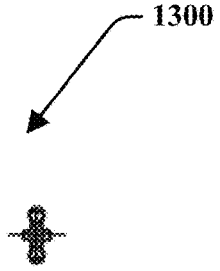
Figure 13A:
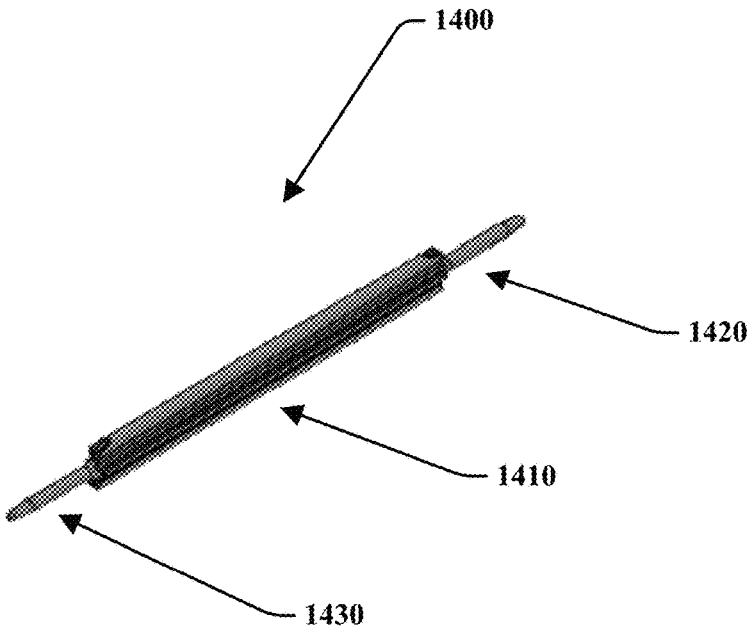
FIGS. 13A-D show various views of an embodiment of a medium rod operatively engageable with a connector or another rod in accordance with aspects disclosed herein.
Figure 13C:
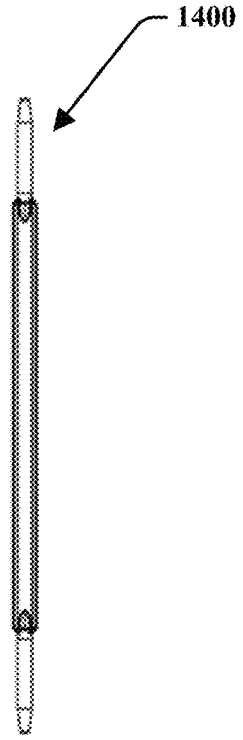
Figure 13B:
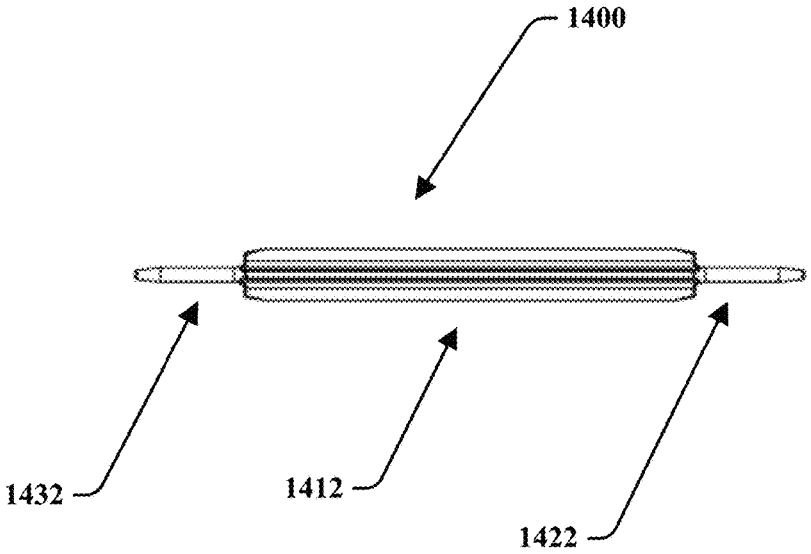
Figure 13D:
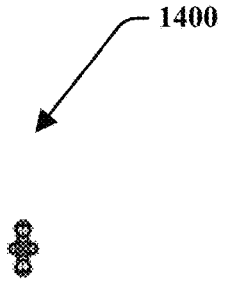
Figure 14A:
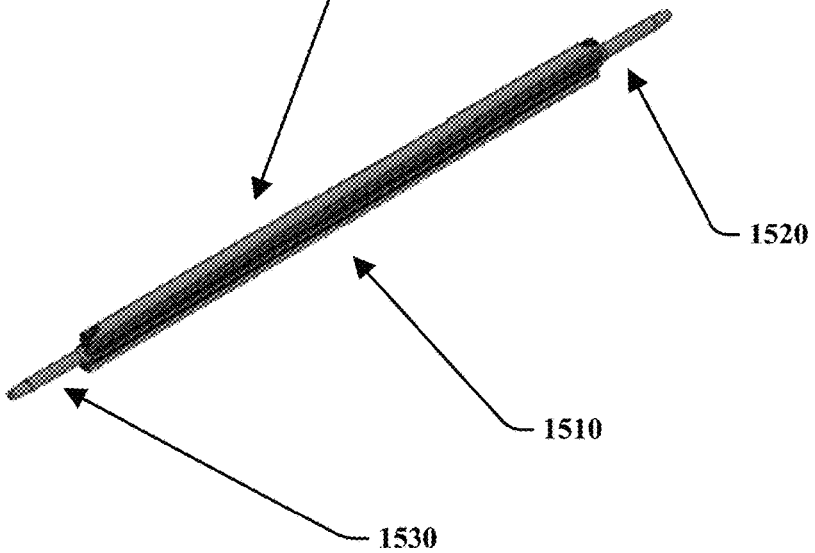
FIGS. 14A-D show various views of an embodiment of a long rod operatively engageable with a connector or another rod in accordance with aspects disclosed herein.
Figure 14C:
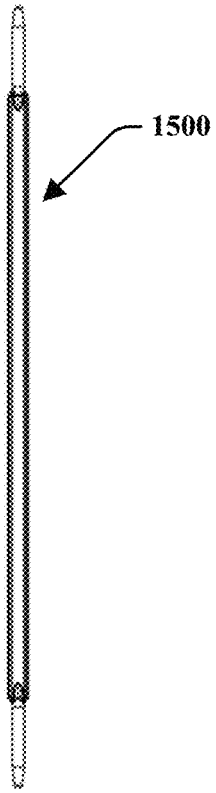
Figure 14B:
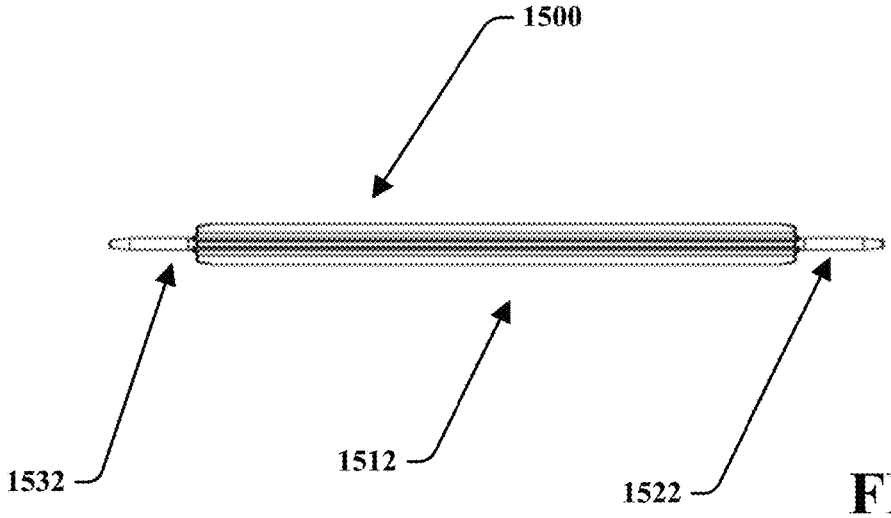
Figure 14D:
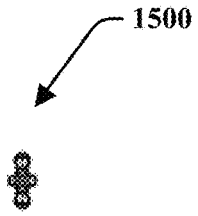

FIGS. 10A-D depict an embodiment of a second wheel connector 1000. The second wheel connector 1000 may include a hub 1010, a rim 1020, and a plurality of spokes 1030, 1040, 1050, 1060, 1070 etc. As shown in FIGS. 10C-D, the second wheel connector 1000 may generally form a planar shape where the plurality of spokes may be positioned in the same 2-D plane and at a substantially similar angle from one another to generally comprise a circle. In an embodiment, the plurality of spokes may generally connect the hub 1010, located generally in the center of the second wheel connector 1000, to the rim 1020, wherein the rim 1020 may circumscribe an area defined by the plurality of spokes. While the specific illustrated embodiment may include 5 spokes, it is noted that any number of one or more spokes may be suitable, including 2, 3, 4, 5, 6, 7, 8, 8, 10, or more spokes. In an example, the plurality of spokes may be thick or wide, so as to cover greater area between the hub 1010 and the rim 1020. In this embodiment, the second wheel connector 1000 may comprise fewer spokes, such as 2-8 spokes. In an example, the plurality of spokes may be thin and the second wheel connector may comprise more spokes, such as 9 or more spokes. It is also noted that the second wheel connector 1000 may include no spokes, and instead comprise a continuous face that generally connects the hub 1010 and the rim 1020. Similarly, the wheel connector 1000 may include a generally continuous face with one or more apertures that generally connects the hub 1010 and the rim 1020.

In an embodiment, the hub 1010 may generally comprise an aperture and serve as a receiving portion for an axle, such as the axle 1100 shown in FIGS. 11A-D. The axle 1100 may include a base 1110 having a first end and mating portion 1120 and a second end and mating portion 1130. In an example, the first end and mating portion 1120 may be operatively coupled with the hub 910, 1010 of the first 900 or second 1000 wheel connector. For examples, the first end and mating portion 1120 may fit into the aperture or hole that is the hub 910, 1010. In an embodiment, the first end and mating portion 1120 may comprise a first arm 1122 and a second arm 1124. The first arm 1122 and second arm 1224 may be slightly displaced from each other and may comprise a clip front that is narrow or tapered to facilitate insertion of the first mating portion 1120 into the hub 910, 1010, wherein the arms may be pressed closer together during insertion of the first mating portion 1120 into the hub 910, 1010. The clip front may also protrude from the remaining length of the first mating portion 1120 to operatively lock or secure the first mating portion 1120 into the hub 910, 1010. In an example, the connection or attachment between the first mating portion 1120 of the axle 1100 to the hub 910, 1010 of the first 900 or second 1000 wheel connector may be friction fit, snap fit, pressure fit. In order to release the axle 1100 from the wheel 900, 1000, the clip front or first arm 1122 and second arm 1224 may be pressed together so as to allow the protruding clip front to go back through the hub 1010. In another embodiment, the axle 1100 may be permanently connected or attached to the wheel connector 900, 1000 by mechanism attachment like a screw or adhesive.

The second end and mating portion 1130 may be the same as or similar to the first end and mating portion 1120, or the second end and mating portion 1130 may be different. In an embodiment, the second end and mating portion 1130 may include a first arm 1132 and a second arm 1134 slightly displaced from each other. The first arm 1132 and a second arm 1134 may form an aperture 1140 therebetween. In an embodiment, the aperture 1140 may continue through the base 1110 and, in some cases through the first end and mating portion 1120. The aperture 1140 may be configured to receive another component of the toy picks system including a body or first mating portion 1312 or a first or second end or second mating portions 1322, 1332 of a rod 1300 (or toothpick) as described below. The aperture 1140 may be configured to receive another component of the toy picks building system, including, without limitation any of the other components described herein, including without limitation any of the rods, any of the connectors, plastic or wooden toothpick, straw, stirrer, and the like.

FIGS. 12-15 depict various embodiments of a rod 1300. In an embodiment, the rod may vary in length. As shown in FIG. 15, the rod may be a short rod 1300, a medium rod 1400, or a long rod 1500. It is noted, however, that the rods may be provided in any length and may include 10, 20, 30, etc. different lengths as is desired in the toy picks building system. The rod 1300 may generally include a body 1310. The body 1310 may serve as a first mating portion 1312 configured to attach or connect to the first receiving portion of any of the connectors disclosed herein. In an example, FIG. 16 shows the first mating portion 1312 being inserted into the first receiving portion 710 of a four-arm connector 700. The body 1310 of the rod 1300 may include various engagement features such as grooves, ridges, channels, tracks, protrusions, projections, or the like, that correspond to the first receiving portion of a connector. The fit may be a pressure fit, a snap fit, a twist fit, a screw fit, or the like, to enable the operative attachment, detachment, and reattachment of any two pieces of the toy picks building system.

Figure 17:
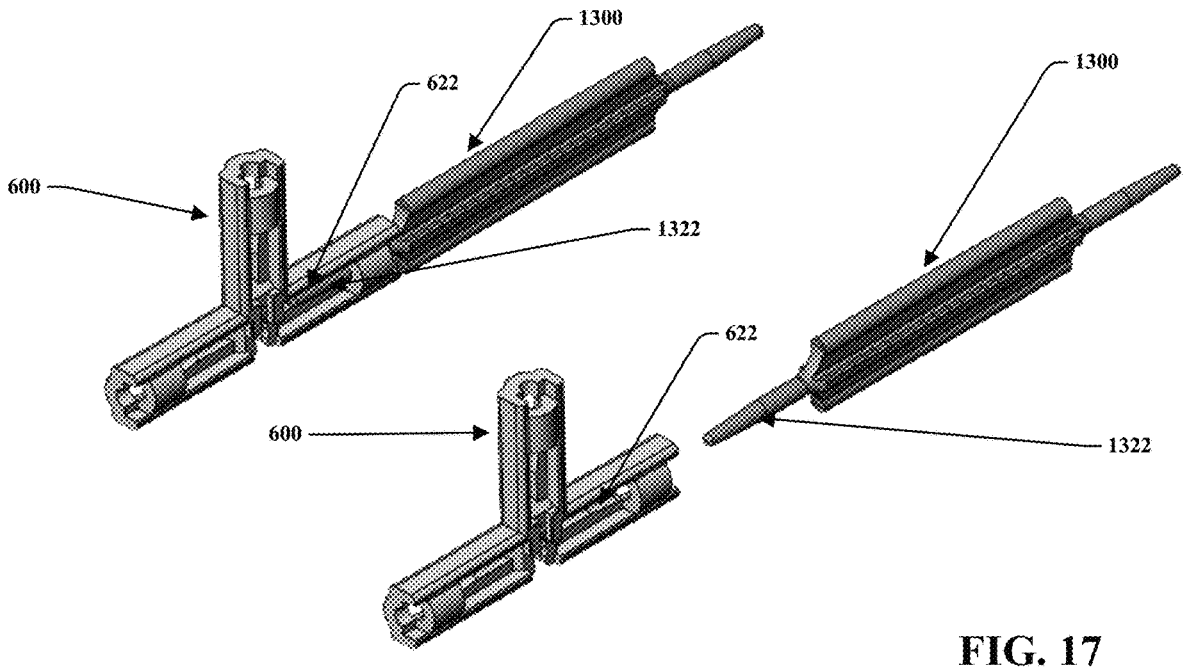
FIG. 17 shows an embodiment of a connection between a rod and a connector in accordance with aspects disclosed herein; and, FIG. 18 shows an embodiment of a connection between two connectors in accordance with aspects disclosed herein.

The rod 1300 may further include a first end 1320 and a second end 1330. The first end 1320 and the second end 1330 may be different or the same as one another. In an embodiment, the first end 1320 and the second end 1330 each comprise a second mating portion 1322, 1332 that is configured to attach or connect to any of the second receiving portions of the arms of the connectors disclosed herein. In an example, FIG. 17 shows the second mating portion 1322 of the first end 1320 of the rod 1300 being inserted into the second receiving portion 622 of a three-arm connector 600. The first end 1320 and/or second end 1330 of the rod 1300 may include various engagement features such as grooves, ridges, channels, tracks, protrusions, projections, or the like, that correspond to the second receiving portions of a connector. The fit may be a pressure fit, a snap fit, a twist fit, a screw fit, or the like, to enable the operative attachment, detachment, and reattachment of any two pieces of the toy picks building system. In an embodiment, the first end 1320 and/or second end 1330 of the rod 1300 is rotatable within the second receiving portion of the connector. Further, the first end 1320 and/or second end 1330 may be configured with a generally blunt end to prevent the rod 1300 from poking the user. Some users may prefer to utilize the blunt ends 1320 and 1330 of the rod 1300 as opposed to a toothpick. Although, as shown in FIG. 17, the rod 1300 may be replaced with a toothpick such that where the rod 1300 is shown, it may be replaced with a plastic or wooden toothpick, straw, stirrer, and the like.

In an embodiment, the short rod 1300, medium rod 1400, and long rod 1500 each have corresponding bodies, ends, and first and second mating portions as described above and illustrated in FIGS. 12-14.

Further, each of the embodiments of the connectors, 100, 200, 300, 400, 500, 600, 700, 800, 900, 1000, 1100 and the rods 1300, 1400, 1500 and the toothpicks described above and similar such existing materials utilized to operatively attach the connectors may be used with a motorizing device. The motorizing device may allow a user to build a design and then motorize the design so that it may move in some capacity. The present teachings are not limited to any specific type of motorized device. By way of a non-limiting example, the motorizing device may comprise small electric motors, permanent magnet motor, hobby motor, a solar motor, or the like. The motorizing device may include one of the connectors, e.g., 100. The connector 100 may be utilized to operatively connect any of the other connectors 100, 200, 300, 400, 500, 600, 700, 800, 900, 1000, 1100 and the rods 1300, 1400, 1500 and the toothpicks to form the desired end product. The foregoing may be utilized to create any kind of end product. The present disclosure is not limited to any specific end product. The examples of such end products are so exhaustive that for the sake of efficiency not all end products can be described. The motorized device may help bring animation to the end product so that it moves. Further still, the motorized device may include an electronic communication portion so that it may operatively communicate with a computing device, e.g., a smartphone, tablet, computer, dedicated remote control or the like. The electronic communication portion may be a wired or wireless communication device. Examples of a wireless communication may include, without limitation, Bluetooth, ZigBee, Wi-Fi, Bluetooth Low Energy and WiMAX. The present teachings, however, are not limited to these wireless communication systems. Any appropriate wireless communication system may be utilized without departing from the present teachings.

Although the embodiments of the present teachings have been illustrated in the accompanying drawings and described in the foregoing detailed description, it is to be understood that the present teachings are not to be limited to just the embodiments disclosed, but that the present teachings described herein are capable of numerous rearrangements, modifications and substitutions without departing from the scope of the claims hereafter. The claims as follows are intended to include all modifications and alterations insofar as they come within the scope of the claims or the equivalent thereof

What is claimed is:

1. A toy building system comprising:

a connector, wherein the connector comprises at least one arm and the at least one arm comprises a first end, a second end, a body, and an elongated channel that extends from at least one of the first or second end and through a length of the body, wherein the elongated channel serves as a first mating portion and is configured to operatively receive a first mating piece, wherein the connector comprises a recess;

a second connector, wherein the second connector comprises at least one second arm and the at least one second arm comprises a second recess;

wherein the recess of the connector is configured to mate with the second recess of the second connector securing the connector with the second connector.

2. The toy building system of claim 1 further comprising a rod, wherein the rod includes a first end, a second end, and a body, wherein at least the first end or the second end is an elongated end and wherein the elongated end forms the first mating piece.

3. The toy building system of claim 1, wherein the connector includes two arms and wherein the two arms are positioned linearly at a 180° angle.

4. The toy building system of claim 3, wherein the arms connect at a juncture and the juncture further comprises a second mating portion configured to receive a second mating piece.

5. The toy building system of claim 4, wherein a body of a rod or a juncture of a second connector forms the second mating piece.

6. The toy building system of claim 1, wherein the connector includes two arms and wherein the two arms are positioned at a 90° angle.

7. The toy building system of claim 1, wherein the connector includes two arms and wherein the two arms are positioned at an obtuse angle.

8. The toy building system of claim 1, wherein the connector includes two arms and wherein the two arms are positioned at an acute angle.

9. The toy building system of claim 1, wherein the connector includes three arms and wherein the three arms are positioned in a planar T-shape.

10. The toy building system of claim 1, wherein the connector includes three or more arms and wherein the three or more arms are positioned in a same plane.

11. The toy building system of claim 10, wherein the three or more arms are positioned around a center point.

12. The toy building system of claim 11, wherein 7 arms are positioned around a center point to form 7 spaces between adjacent arms and wherein 6 of the spaces are equal angles.

13. The toy building system of claim 1, wherein the connector includes three or more arms and wherein at least one arm is positioned in a different plane.

14. The toy building system of claim 1, further comprising a wheel, wherein the wheel includes a central hub including an aperture, a plurality of arms positioned planarly around the central hub, and an outer rim, wherein each of the plurality of arms include a first end, a second end, a body, and an elongated channel that extends from the first end and through a length of the body, wherein the elongated channel serves as a first mating portion and is configured to operatively receive the first mating piece.

15. The toy building system of claim 14 further comprising an axle that is operatively engageable with the central hub of the wheel and wherein the axle includes a channel configured to operatively receive the first mating piece.

16. The toy building system of claim 1, wherein the toy building system is formed from one or more of plastics, acrylics, polymers, or silicones.

17. The toy building system of claim 1, wherein the toy building system is 3-D printed, molded, stamped, or extruded.

18. The toy building system of claim 1, wherein the first mating piece is an end of a toothpick.

19. A toy building system comprising:

first and second connectors and at least one rod, the first connector comprising at least two arms each having a first end, a second end, and a body, wherein each arm includes a first receiving cavity at the first end and through a length of the body, wherein the second ends of each arm connect at a juncture, and wherein the first connector comprises a second receiving cavity at the juncture and wherein the first connector comprises a recess, the second connector comprising a second recess, wherein the recess of first the connector is configured to mate with the second recess of the second connector securing the first connector with the second connector, and the rod comprising a first end, a second end, and a body, wherein the first end comprises a first corresponding mating portion configured to operatively engage the first receiving cavity of the connector and wherein the body comprises a second mating portion configured to operatively engage the second receiving cavity of the connector.

* * * * *